US005154123A

United States Patent [19]

Loomer

[11] Patent Number: 5,154,123

[45] Date of Patent: * Oct. 13, 1992

[54] RAIL CONVEYOR AND RAIL SWITCHES THEREFORE

[75] Inventor: Weston R. Loomer, Walton, Ky.

[73] Assignee: Litton Industrial Automation Systems, Inc., Florence, Ky.

[ * ] Notice: The portion of the term of this patent subsequent to Apr. 17, 2007 has been disclaimed.

[21] Appl. No.: 219,919

[22] Filed: Jul. 15, 1988

[51] Int. Cl.[5] ..... B61B 3/00

[52] U.S. Cl. ..... 104/102; 104/96

[58] Field of Search ..... 104/91, 96, 99, 102; 246/416, 417, 418, 378, 380, 392, 429; 238/219, 230

[56] References Cited

U.S. PATENT DOCUMENTS

| | | | |
|---|---|---|---|
| 350,855 | 10/1886 | Woodward | 104/99 |
| 685,822 | 11/1901 | Cook | 104/99 |
| 896,499 | 8/1908 | Witthoefft | 104/99 |
| 1,020,046 | 3/1912 | Neller | 104/99 |
| 1,632,557 | 6/1927 | Moon | 104/102 |
| 1,887,252 | 11/1932 | Thomas | 238/219 |
| 2,138,962 | 12/1938 | Forker, Jr. | 104/102 |
| 2,996,017 | 8/1961 | Gorjanc et al. | 104/102 |
| 4,917,018 | 8/1990 | Loomer | 104/102 |

FOREIGN PATENT DOCUMENTS

| | | | |
|---|---|---|---|
| 380450 | 12/1907 | France | 238/219 |
| 504596 | 4/1939 | United Kingdom | 238/219 |

*Primary Examiner*—Margaret A. Focarino
*Assistant Examiner*—Dean J. Kramer
*Attorney, Agent, or Firm*—Morris I. Pollack

[57] ABSTRACT

Diversion-type switches and cross-type switches are provided for inclusion in suspended rail conveyor arrangements to form a rail conveyor system. Each of said switches includes at least one shiftable rail section movable between a first position of cooperation with spaced rails of one conveyor pathway and a second position of cooperation with spaced rails of another conveyor pathway. Rail alignment and load transmitting elements, in the configuration of coacting fingers and seats, are disposed at the respective end of the shiftable rail section and fixed rail section and coact therewith so that load forces acting on the shiftable rail section act to align the shiftable rail section with the spaced rails of the respective conveyor pathways and so that load forces applied to the shiftable rail section are transmitted directly to the fixed rail section. Operating elements, including cams and cam followers are provided to move the shiftable rail section to separate the rail alignment and load transmitting elements to shift the shiftable rail section and to bring together the rail alignment and load transmitting elements.

30 Claims, 7 Drawing Sheets

FIG. 4
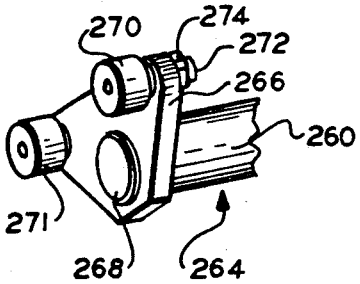
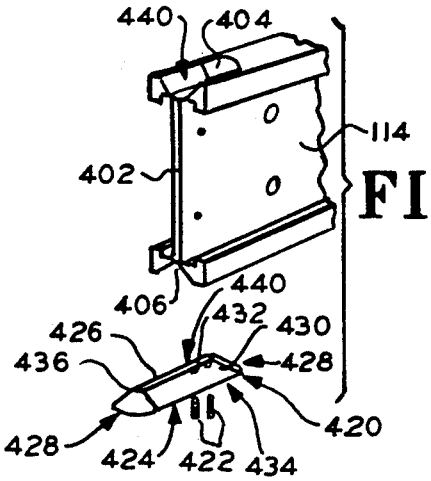
FIG. 4A
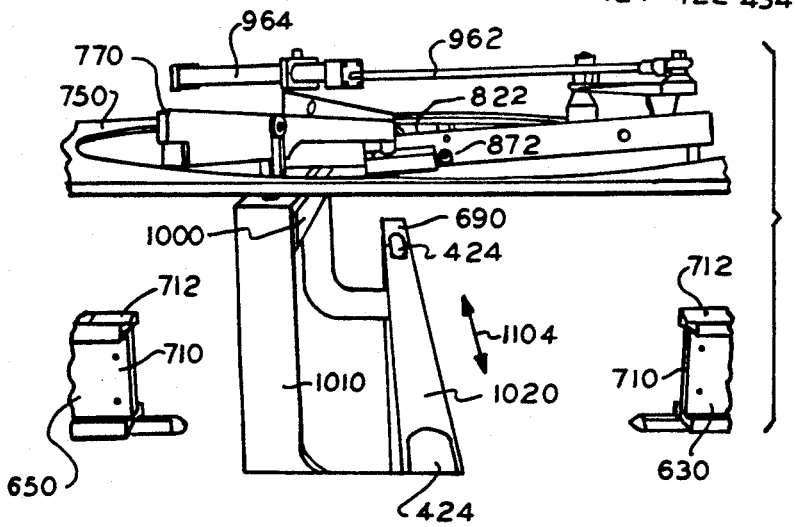
FIG. 16
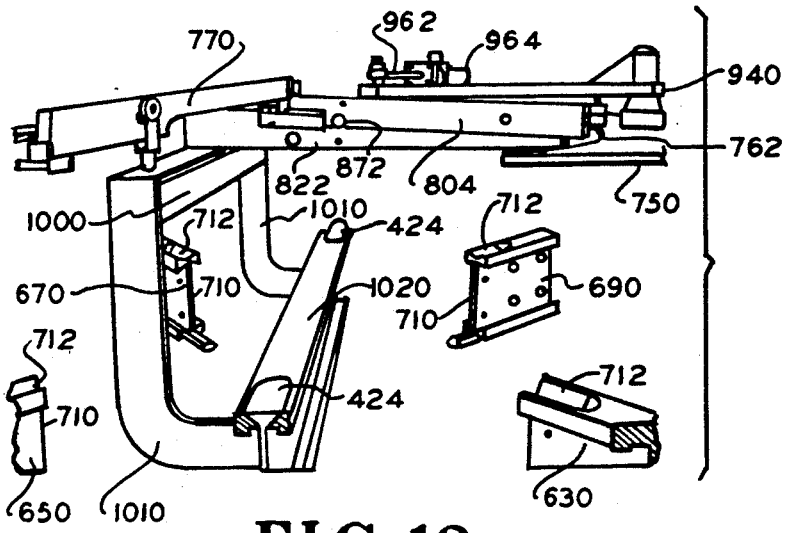
FIG. 18

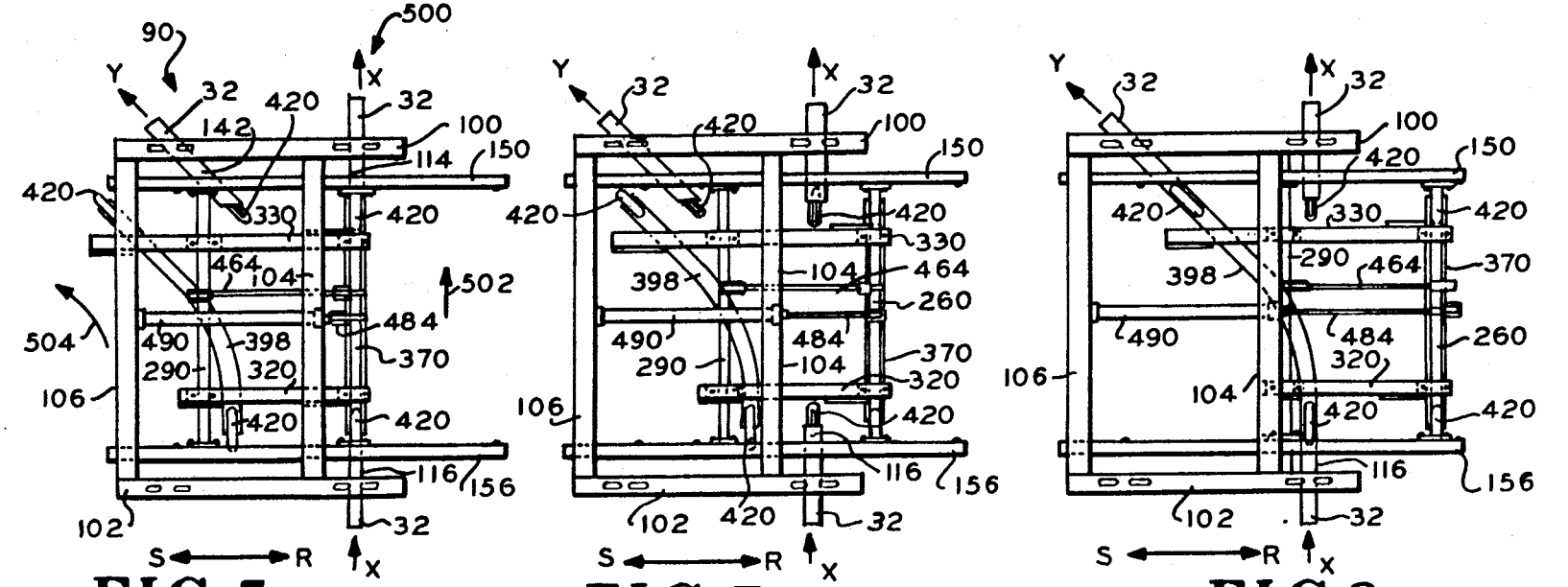
FIG.5
FIG.7
FIG.9
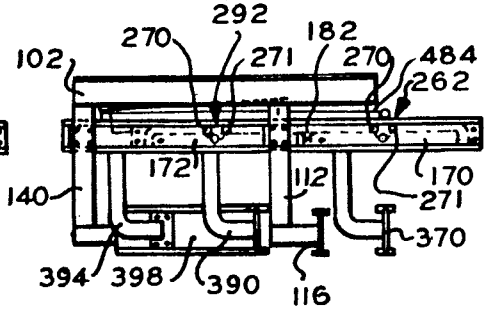
FIG.8
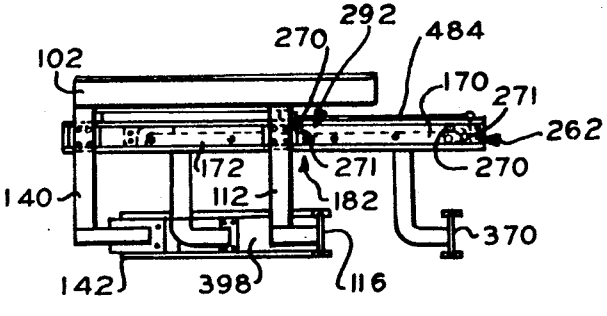
FIG.10
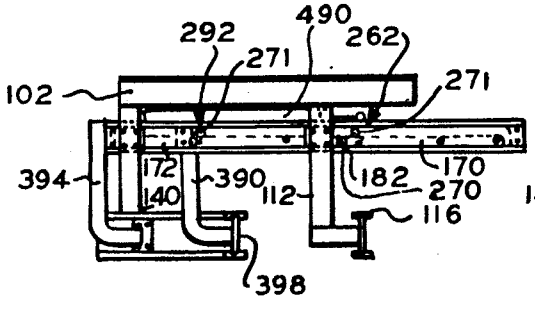
FIG.6

RAIL CONVEYOR AND RAIL SWITCHES THEREFORE

BACKGROUND OF THE INVENTION-FIELD OF APPLICATION

This invention relates to conveyors; and more particularly to rail conveyors and rail switches utilized with and forming part of such rail conveyors.

BACKGROUND OF THE INVENTION-DESCRIPTION OF THE PRIOR ART

Rail conveyors utilize rails or tracks to define a pathway or trackway along which article carriers move to convey articles from one or more locations along the way to another location or locations along the way. The articles being conveyed may take any desired configuration size and weight from small to large and from material and equipment parts, components, sub-assemblies and assemblies to entire articles and even people.

Some rail or track conveyors utilize a single rail or track (i.e. a monorail) to define the pathway or trackway; while other conveyors utilize a pair of spaced rails or tracks. Some conveyors suspend the rails or tracks from roofs, ceilings, walls or ground mounted supports; while others provide a ground mounted bed upon which the rails or tracks define the pathway. Where the pathway rests upon the ground or other base the article carrier rides on top of the rail tracks with the article also disposed above the rails or tracks. For suspended rail and track conveyors the article carrier will usually ride on top of the rail or track or on top of a horizontally projecting portion thereof. Quite often the articles being conveyed by a suspended rail or track conveyor are disposed beneath the rail or track, however, disposition above the rail or track is also possible.

Many rail or track conveyors utilize a number of different but interconnected pathways and thus require switches to facilitate movement of the article carrier between pathways (track or line switches), such as shown in U.S. Pat. No. 1,570,934 granted on Jan. 26, 1926 to E. T. Bennington for Tramrail Switch and U.S. Pat. No. 2,526,819 granted on Oct. 24, 1950 to F. J. Henderson for Conveyor Track Switch, and/or to enable article carriers moving along one pathway to crossover another pathway (intersecting or crossover switches) such as shown in U.S. Pat. No. 1,696,946 granted on Jan. 1, 1929 to F. E. Felts for Switching System For Suspended Railways. Such switches seek to alternately align a first, second or possibly third movable section of rail or track with opposed and spaced rails or tracks defining a desired first, second or possibly third pathway. However, in doing so, they almost invariably require a heavy, cumbersome and costly support structure for the shiftable rail sections and the shifting actuator structure. Of even greater concern is that such heavy and cumbersome switch constructions must in turn be supported in disposition with respect to the rail or track members between which the article carriers are to be routed and in such a manner that the load carried by the article carrier be supported while moving through the switch.

Switches, such as those shown in the previously mentioned patents, merely seek to align the movable rail sections with the fixed rail sections and as such must be built and supported with such heavy cumbersome and costly constructions to enable the load to move through the switch.

Rail alignment is also most important if the article carrier and its load is to be smoothly and efficiently shifted between and through intersecting pathways with a minimum of noise. Some rail conveyors see such as those shown in: U.S. Pat. No. 541,365 granted on Jun. 18, 1895 to E. Langen for Switch For Overhead Railways; and in U.S. Pat. Nos. 2,887,067 and 2,887,068 both granted on May 19, 1959 to H. A. Cotesworth for Overhead Monorail System and Overhead Monorail System And Track Switch Therefor respectively, seek to insure rail alignment with latching mechanisms, however, these mechanisms add more weight and additional costly movable elements to already heavy cumbersome and costly switch structures.

Some rail switches, such as those shown in the previously described patents to Bennington and Henderson rely upon operator strength and effort to move the switch between its various positions. Obviously, the heavier the switch the greater the effort required. Other switches such as those shown: in U.S. Pat. No. 1,453,024 granted to T. B. Ryon on Apr. 24, 1923 for Switching Mechanism; U.S. Pat. No. 2,996,017 granted to H. A. Gorjanc et al on Apr. 15, 1961 for Overhead Monorail Track Switch; U.S. Pat. No. 3,046,909 granted to H. A. Gorjanc on Jul. 31, 1962 for Material Handling Device; and U.S. Pat. No. 3,223,048 granted to H. A. Gorjanc on Dec. 14, 1965 for Mono-Rail Track Switch utilize the power of an electric motor to move the switch structure between its various positions. Still other switches, such as shown in U.S. Pat. No. 2,840,006 granted to F. J. Henderson on Jun. 24, 1958 for Conveyor Track Switch and in U.S. Pat. No. 4,109,584 granted on Aug. 29, 1978 to Kiyoshi Mihirogi for Track Switching Device For Two-Rail Type Tracks utilize hydraulic mechanisms to move the switch between its various positions. Here again, all this structure and its weight must be supported as well as the load passing over the switch.

Some prior art track switches such as shown in U.S. Pat. No. 1,632,557 granted on Jun. 14, 1927 to C. L. Moon for Trolley Switch and in U.S. Pat. No. 2,138,962 granted to J. B. Forker, Jr. on Dec. 6, 1938 for Switch allude to distributing and minimizing switch and article loads, however, in devices such as shown by Moon the article load must still be transmitted through the structure of the switch that supports the shiftable track members. This requires that those portions of the switch be sufficiently strong to carry and transmit not only their own weight but that of the carrier and its load. This requires a structure that adds weight, bulk and cost to the switch and track system.

SUMMARY OF THE INVENTION

It is therefore an object of this invention to provide new and improved rail conveyors.

It is another object of this invention to provide new and improved rail switches for use with rail conveyors.

It is yet another object of this invention to provide a new and improved line or path diversion switch for rail conveyors.

It is yet another object of this invention to provide a new and improved intersection or cross-over switch for rail conveyors.

It is still another object of this invention to provide new and improved switches for rail conveyors and new and improved rail conveyors systems utilizing such new and improved switches wherein the switches are relatively simple in construction, relatively light in weight and relatively less expensive in cost.

It is still another object of this invention to provide new and improved switches for rail conveyors and new and improved rail conveyors systems utilizing such new and improved switches wherein at least a portion of the weight of a shiftable rail section of said switches and at least a portion of the load passing across said shiftable rail section is transmitted to and carried by fixed rail members of the rail conveyor.

It is yet still another object of this invention to provide new and improved rail switches and new and improved rail conveyors which utilize such new and improved rail switches wherein one or more portions of shiftable rails carried by a switch coact with one or more portions respectively of fixed rail members disposed proximate the switch to effect alignment of a shiftable rail portion with predetermined but spaced fixed rails to form therewith a continuous conveyor pathway.

It is yet still a further object of this invention to provide new and improved rail switches and new and improved rail conveyors which utilize such new and improved rail switches wherein load forces applied to one or more portions of shiftable rails carried by a switch effects coaction thereof with one or portions respectively of fixed rail members disposed proximate the switch and alignment of the shiftable rail portion with predetermined but spaced fixed rails to form therewith a continuous conveyor pathway.

This invention involves rail conveyors and rail conveyor switches utilized therewith to provide alternate rail pathways and to facilitate movement of an article carrier moving along the rail conveyor through an intersection of one rail pathway with another rail pathway. It further involves rail switches which include one or more rail sections shiftable between selected positions such that a particular shiftable rail section is aligned with and forms a pathway with fixed rail members whose opposed ends are spaced one from the other to receive there between the selected shiftable rail section. The invention contemplates constructing the shiftable rail sections and fixed rails with one or more specially configured fingers projecting from the respective ends therefore that are to be aligned to form the continuous rail pathway and with a corresponding number of cooperating and specially configured seats each configured to receive a finger when the shiftable rail is shifted into such alignment. The fingers and seats are of a configuration and disposition to align the shiftable rail with the fixed rails to form the continious rail pathway and to transmit to the fixed rails, and there respective support, at least a portion of the weight of the shiftable rail, the switch support structure therefore and of any load passing through the switch along the rail pathway.

Other objects features and advantages of the invention in its details of construction and arrangement of parts will be seen from the above, from the following description of the preferred embodiment when considered with the drawing and from the appended claims.

BRIEF DESCRIPTION OF DRAWINGS

FIG. 4 is an enlarged perspective view of the cam follower arrangement of the mechanism of FIG. 3;

FIG. 4A is an enlarged perspective of an end portion of a section of conveyor rail showing a location and load transmission finger and seat thereof;

FIG. 5 is a plan view of a diversion switch shown in position for completing a first rail conveyor pathway;

FIG. 6 is an elevation view of the switch of FIG. 5;

FIG. 7 is a plan view of the switch of FIG. 5 shown in a position intermediate to the first rail conveyor pathway of FIG. 5 and a second rail conveyor pathway;

FIG. 8 is an elevation view of the switch of FIG. 7;

FIG. 9 is a plan view of the diversion switch of FIGS. 5 thru 8 shown in position for completing the second rail conveyor pathway;

FIG. 10 is an elevation view of the switch of FIG. 9;

FIG. 16 is perspective view of the switch of FIG. 15 looking in the direction of arrow "B" of FIG. 15; FIG. 18 is a perspective view of the switch of FIG. 17 looking in the direction of arrow "A" of FIG. 17 and with parts removed to better show the details of construction;

DESCRIPTION OF THE PREFERRED EMBODIMENT

For convenience, the invention will be described as applied to a rail on track conveyor system of the single or mono-rail type; wherein a plurality of conveyor pathways are defined by an arrangement of rails or tracks disposed at a level above the floor, or ground, by means of both floor mounted and ceiling mounted supports; and wherein a number of article carriers travers the pathways along the rail and so as to each carry a load suspended beneath the rail. It being understood, never the less, that without departing from the scope of the invention: that the conveyor pathways may be defined by pairs of spaced and cooperating rails or tracks instead of a single rail or track; that the system may define but a single continuous pathway with a single cross-over and a single alternate branch or spur on the system may incorporate any desired number of pathways, branches, spurs, and/or cross-overs; that the rail or track arrangement may be suspended above the floor or ground level by means of either floor mounted, ceiling mounted or wall mounted supports or combinations thereof or alternative supporting arrangements, or, for that matter the rail or track arrangement may be disposed proximate floor or ground level on a suitable rail-bed; that the system may employ, but a single article carrier or any selected number of article carriers; and that the suspended article carriers may carry their respective load above or below the rail, while an article carrier traversing a floor mounted rail would carry its load above the rail.

Figure 1:
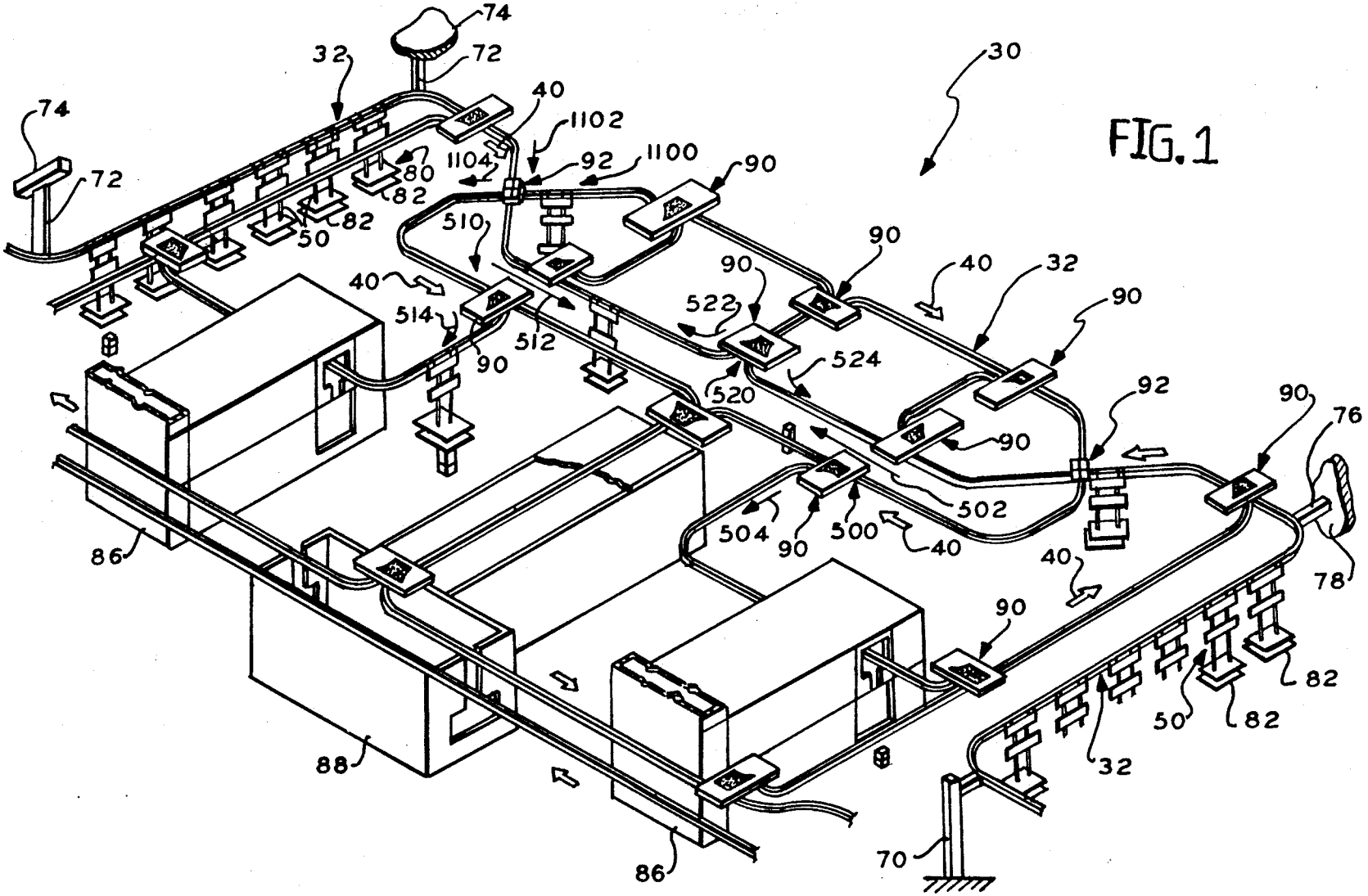
FIG. 1 is a schematic perspective of a rail conveyor system incorporating the instant invention and which utilizes switches incorporating the instant invention.

With reference to FIG. 1, there is generally shown at 30 a monorail-type rail conveyor system incorporating a rail arrangement 32 which includes a number of conveyor pathways such as those defined by arrows 40. A plurality of article carriers 50, of conventional construction, are carried by rail arrangement 32 for movement therealong with each such carrier including appropriate and conventional motor, power, and drive assemblies. Carriers, such as carrier 50, conventionally and for purpose of this description, receive their drive energy and control signals through electrical bus-bar type arrangements (not shown), conventionally mounted to rail arrangement 32 and disposed for coaction with suitable pickup mechanisms on each carrier 50. Appropriate and conventionally available computerized controls (as from a microprocessor or other type computer) with suitable and conventionally available software provide and facilitate the controls required to direct carriers 50 about a system 30.

Rail arrangement 32 is mounted, in suspended fashion, from floor mounted support pillars 70 (FIG. 1), from overhead support members 72 which extend down from and are secured to a ceiling or other overhead structure 74, and/or from side supports 76 which extend from and are secured to vertically disposed supports such as walls 78 or the like. Rail arrangement 32 is secured to supports 70 and/or 72 and/or 76, or combinations thereof by suitable and conventional means, and in such a way that carriers 50 extend downwardly therefrom.

Carriers 50 each include load carrying members 80 of a size and configuration to position and carry an intended load 82. Load 82 may be a part or number of parts, a sub-assembly, an assembly, or an entire article of manufacture such as an automobile, typewriter or the like. It may include a single boxed or packaged item or a number of boxes or packages, or it may include people in a carrier suitable to hold and transport people.

A system such as rail conveyor system 30 is usually set up so that rail arrangement 32 will direct carriers 50 and their respective loads to one or more work stations, such as stations 86, 88 where the parts, assemblies, equipment, or the like, may be machined, assembled, disassembled, tested, stored, or some similar activity take place, or picked up for movement to another work station. If people are the article being carried, the work stations would constitute stops on the rail line.

To facilitate the versatility of rail arrangement 32, it may include one or more diversion-type switches 90 so that a carrier 50 traveling along a particular section or rail path may either continue straight through or be directed off to one side, and/or the other side, onto another section of rail path or onto a spur. Rail arrangement 32 also includes a number of cross-over type switches 92 so that a carrier 50 traveling along a particular section of rail path may cross over another rail path that intersects with the rail path the carrier is traveling on. Switches 90 and 92 will be described in detail with reference to FIGS. 2–18.

Each switch 90 includes a support assembly 94 fixedly secured in position with respect to fixed portions of rail arrangement 32 by suitable and appropriately disposed switch mounting supports. Such mounting supports might include floor mounted supports, such as pillars 70 (FIG. 1), overhead support members 72 (FIGS. 1 and 2) or side supports, such as supports 76 (FIG. 1). A suitable number of overhead supports 72 (only one shown in FIG. 2) extend down from a fixed overhead support mounting such as ceiling 74, and are suitable connected, as by fasteners (not shown) to a side rail 100 of support assembly 90. Additional support members, such as members 72, would also be connected to a side rail 102, spaced from side rail 100 and fixedly connected thereto by cross-beams 104 and 106, interconnected between rails 100 and 102 by suitable means such as welding, to firmly and fixedly position switch 90 in operative position with respect to rail arrangement 32.

A pair of spaced, vertically disposed support posts 110, 112, fixedly connected to cross-beam 104 as by welding, extend down from cross-beam 104 and mount fixed rail sections 114, 116 respectively by way of horizontally extending support beams 118, 120 which are fixedly secured at first ends to posts 110, 112 respectively as by welding and which, in turn, mount at their respective other ends rail sections 114, 116 by suitable fastener means 122 such as threaded bolts and cooperating nuts. Fixed rail sections 114, 116 are so mounted in a spaced and aligned disposition for purposes to be hereinafter explained. A first free end 126 of fixed rail section 114 is fixedly positioned and aligned within rail arrangement 32 and secured thereto by a connector plate 127 and suitable fastening means such as bolts and nuts 122 to form therewith a continuous pathway. A first free end 128 of rail section 116 is likewise also fixedly positioned and aligned within rail arrangement 32 and secured thereto by a connector plate 127 and suitable fastening means such as bolts and nuts 122 to form said continuous pathway.

Another vertical support post 140, which extends down from and is suitable connected as by welding or the like to cross-beam 106 proximate one end thereof, mounts a fixed rail section 142 by way of a horizontally extending support beam 144 which is fixedly secured at one end as by welding to post 140 and which in turn mounts at its second end rail section 142 by suitable fastening means such as fasteners 122. Fixed rail section 142 is so mounted so that a free end 146 thereof is disposed in fixed position and in alignment with rail arrangement 32 and secured thereto by a connector plate 127 and suitable fastening means such as bolts and nuts 122. It should be noted that fixed rail section 142 is disposed at an angle with respect to fixed rail section 114 for purposes to be described herein below with the continued description of switch 90.

A first horizontally extending support rail 150 is fixedly secured as by threaded fasteners 152 to posts 110 and 140 in a position below beams 104, 106. A second horizontally extending support rail 156, disposed in horizontal alignment with but spaced from rail 150, is fixedly secured to post 112 as by fasteners similar to fasteners 152 and in a similar manner to a vertically extending post 158 fixedly secured at one end, as by welding, to cross-beam 106. A pair of cam rails 170, 172 (FIGS. 2 and 3) are secured to an inner face 174 (FIG. 2), of rail 156 as by threaded fasteners 176 (FIG. 3) and with adjacent ends 178, 180 spaced from each other to provide a cam space 182. Another pair or cam rails 190, 192 are secured to an inner face 194 (FIG. 2) of rail 150, as by threaded fasteners 196, with adjacent ends 198, 200 (FIG. 3) spaced from each other to provide a cam space 202 and so as to be spaced from but aligned with cam rails 170, 172. Cam rails 170, 172, 190 and 192 have their respective upper corners formed in the configuration of curved cam surfaces 210, 212, 214, 216, 218, 220, 222, and 224 respectively.

Figure 2:
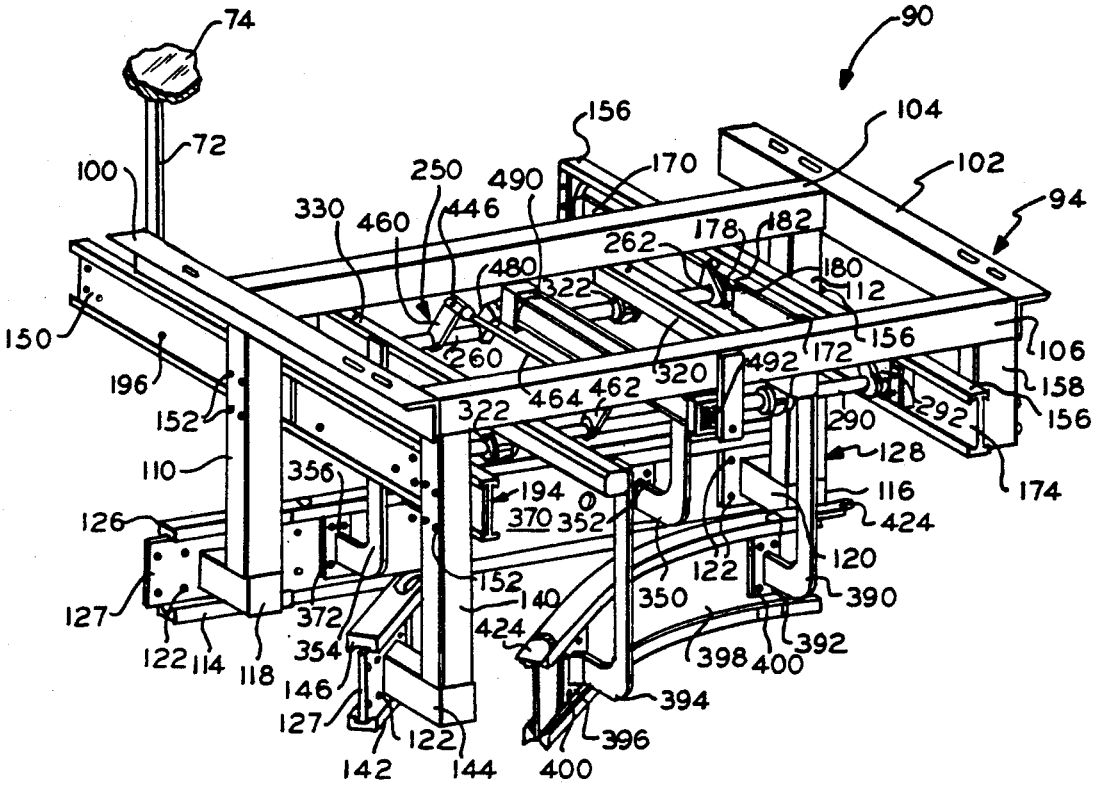
FIG. 2 is a perspective view of a diversion switch of the rail conveyor system of FIG. 1.
Figure 3:
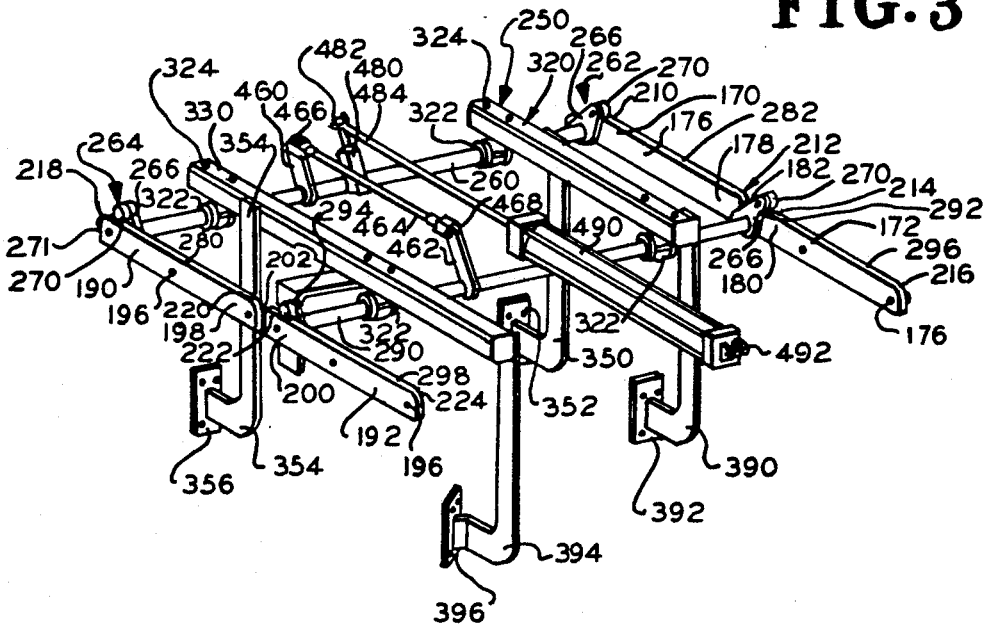
FIG. 3 is a perspective view of the operating mechanism of the switch of FIG. 2.

A rail shifting assembly 250 (FIGS. 2 and 3) is moveably mounted on support assembly 90 for cooperation with cam rails 170, 172, 190 and 192 (FIG. 3) and for movement between selected positions as will be hereinafter described. A first cam rod 260 (FIGS. 2, 3, and 4) spans the space between cam rails 170 and 190 and mounts of its ends cam follower assemblies 262 (FIG. 3) and 264 (FIGS. 3 and 4). Each cam follower assembly 262, 264 includes a mounting plate 266 which is fixedly secured to its respective end of rod 260 so that there is no relative movement between plate 266 and rod 260. A plug 268 is mounted at each end of rod 260. Plugs 268 are formed from a plastic bearing material and function to provide lateral guidance of rod 260 between cam rails 170 and 190. A cam follower roller 270, 271, is rotationally mounted, as by bearings (not shown), on each of spaced studs 272 and are secured in place by suitable means such as internally threaded nuts 274 which are threaded onto cooperating threads formed on studs 272.

Cam follower rollers 270, 271 of cam follower 264 extend towards cam rail 190 for rolling cooperation with cam surfaces 218, 220, and horizontal rail surface 280 disposed therebetween; while cam rollers 270 of cam follower 262 extend in an opposite direction from that of rollers 270, 271 of follower 264 towards cam rail 170 for rolling cooperation with cam surfaces 210 and 212 and horizontal rail surface 282 disposed therebetween. A second cam rod 290 (FIGS. 2 and 3), spanning the space between cam rails 172 and 192, mounts cam follower assemblies 292 and 294 at its respective ends in a manner similar to the mounting of cam followers 262 and 264 respectively on rod 260. Cam follower 292 is constructed and mounted identical to cam follower 262 but with its follower rollers 270, 271 disposed for rolling cooperation with cam surfaces 214, 216 of cam rail 172 and with rail surface 296 disposed therebetween. Cam follower 294 is constructed and mounted identical to cam follower 264 but with its follower rollers 270, 271 disposed for rolling cooperation with cam surfaces 222, 224 of cam rail 192 and with rail surface 298 disposed therebetween. Plugs (not shown) similar to plugs 268 are mounted at each end of rod 290 to provide lateral guidance of rod 290 between cam rails 172 and 192.

A rail support beam 320 (FIGS. 2 and 3) spans cam rods 260, 290 proximate the ends thereof near cam rails 170, 172. A pair of pillow block-like mounts 322 (FIG. 3) are carried proximate the ends of beam 320 and mount bearings (not shown) which, in turn, receive rods 260 and 290 for rotation with respect to beam 320. Mounts 322 are secured to beam 320 by suitable means such as threaded fasteners 324. Another rail support beam 330 (FIGS. 2 and 3) spans cam rods 260, 290 proximate the ends thereof near cam rails 190, 192. Pillow block-like mounts 322 (FIG. 3) are also carried by beam 330 and mount bearings (not shown) which, in turn, receive rods 260 and 290 for rotation with respect to beam 330.

Extending downwardly from and connected to beam 320, as by welding or the like, is a rail support arm 350 (FIGS. 2 and 3) with a free end carrying a rail mounting plate 352 secured thereto as by welding or the like. A similar rail support arm 354 is likewise secured to and extends down from beam 330 in spaced alignment with arm 350 and which also has secured at the end thereof, as by welding or the like, a rail mounting plate 356. A first shiftable rail section 370 (FIG. 2) is secured to arms 350, 354 through plates 352, 356 respectively, by threaded fastening means such as bolts and nuts 372. It should be noted that shiftable rail section 370 is of straight or rectilinear configuration and support arms 350, 354 and plates 352, 356 are disposed to accommodate that configuration of shiftable rail section.

Also extending downwardly from and connected to beam 320, as by welding or the like, is a rail support arm 390 (FIGS. 2 and 3) with a free end carrying a rail mounting plate 392 secured thereto as by welding or the like. A rail support arm 394 is likewise secured to and extends down from beam 330 is spaced relationship with arm 390 and which also has secured at the end thereof, as by welding or the like, a rail mounting plate 396. A second shiftable rail section 398 (FIG. 2) is secured to arms 390, 394 through plates 392, 396 respectively by threaded fastening means such as bolts and nuts 400. It should be noted that shiftable rail section 398 is of curvilinear or curved configuration and that support arms 390, 394 and plates 392, 396 are disposed to accommodate that configuration of shiftable rail section.

The respective ends of shiftable rail sections 370 and 398 and the ends of fixed rail sections 114, 116 and 142 that cooperate therewith are all formed indentically as more clearly shown in FIG. 4A where there is shown, by way of example, an end of a rail section such as rail section 114. An end 402 of rail section 114 is formed at its top with a seat 404 and at its bottom with an identical seat 406. Each such seat 404, 406 is of size and configuration to receive substantially half of a rail locating and load transmitting finger 420 (FIGS. 2 and 4A). Finger 420 is shown in FIG. 4A as exploded from seat 406 and with fastening means, such as threaded fasteners 422, for securing finger 420 to rail section 114 when finger 420 is seated in seat 406 as will be hereinafter explained. In FIG. 2 a finger 420 is shown seated in a seat (not shown) similar to seat 404 but formed in upper ends of rail 398. When finger 420 is seated in a seat, 404 or 406, the respective configurations of finger 420 and seats 404, 406 is such that a surface 424 of finger 420 is disposed flush with the corresponding surface of the rail section.

All fingers 420 are identical in configuration and size and are of sufficient length to span a pair of adjacent rail sections and to be fixedly secured to fasteners 422 to a selected one of said adjacent rail sections as described hereinbelow. Fingers 420 are formed with a body 426 of special configuration (FIG. 4A) with ends 428 in the configuration of frustums of semi-cones that curve around and taper up and in, and with an elongated prism-like center with sides 430 that also taper up and in and has a flat surface 432 disposed in a plane parallel to that of surface 424.

Each seat 404, 406 is formed with a surface 440 that corresponds in size and configuration to a respective end half of a finger 420 so as to receive finger 420 so that its surface 424 will be flush with the rail surface.

One-half 434 of finger 420 (which could be defined by passing an imaginary plane vertically through finger 420 at a location substantially midway between its semiconical ends 428) is provided with openings (not shown) to receive fasteners 422 for attachment of finger 420 within a seat (404, 406) of a rail section and so that the other half 436 of finger 420 extends horizontally out from the rail section. Fingers 420 may be so secured to a rail section with the tapered sides of its body 426 facing down (as when finger 420 is secured in a seat 404) or with the tapered sides of its body 426 facing up (as when finger 420 is secured in a seat 406). Threaded fasteners 422 secure end half 434 of finger 420 to a rail section in position in its seat and so that the surface 424 of finger 420 and that of the rail section remain continuous and relatively smooth so that a carrier 50 can pass relatively noiselessly thereover.

The configuration of body 426 of fingers 420 and of the finger seats (404, 406) are selected for mutual cooperation to center a shiftable rail section (such as rail section 370 or 398) when positioned in cooperative relationship with respect to a fixed rail section (such as rail sections 114 and 116 or rail section 142) to form a continuous rail conveyor pathway therewith. In addition, when a finger 420 is secured to and extends from a finger seat formed in an upper surface of a shiftable rail section, such as seat 404 in section 114 (FIG. 4A), the seating of the extended end 436 of finger 420 in a similarly disposed seat of an adjacent fixed rail section (upon alignment of the shiftable rail section with the fixed rail section) serves to transmit load forces passing through the shiftable rail section to the adjacent fixed rail section and thereby to the support structure for the fixed rail section. As previously described the support structure for the fixed rail sections includes the fixedly supported adjacent rail of rail arrangement 32.

The load forces passing through a shiftable rail section so aligned with fixed rail sections by fingers 420 include the load forces generated by the shiftable rail section itself, possible other load forces generated by the members of switch 90 and load forces generated by a load 80 carried by a carrier 50 passing over the aligned shiftable rail section. Such load forces are transmitted from the shiftable rail section through fingers 420 to the adjacent, aligned, and interconnected fixed rail sections of rail arrangement 32 and do not pass through the support structure for the shiftable rail section. Thus the size, configuration and relative strength of the components of support assembly 92 of switch 90 may be minimized to that necessary to support only that portion of diversion switch 90 which is not supported by adjacent fixed rails and little if any portion of forces generated by a load passing through switch 90. More specifically fingers 420 are fixed secured to and have their end half, 436 extending from both upper ends of first shiftable rail 370 (FIGS. 2 and 5) by having their respective end halves 434 disposed in finger seats, such as seats 404 (FIG. 4A) and fastened therein by fasteners 422 so that the tapered portion of body 426 faces downwardly. Finger seats, such as seats 406, located at the respective lower ends of shiftable rail 370 remain empty. Finger seats, such as seats 404, formed at the respective upper ends of fixed rail sections 114 and 116 (FIG. 7) are left empty while finger seats, such as seats 406, formed at the respective lower ends of fixed rails 114, 116 have fingers 420 fixedly secured therein and extending therefrom and so that the tapered portion of body 426 faces upwardly. Fingers 420 are similarly fixedly secured to and have their end halves 436 extending from both upper ends of second shiftable rail section 398 (FIGS. 2 and 5); while the seats, such as seats 406 formed at the lower corners of rail 398 remain open. In a similar manner the finger seat, such as seat 404, at the top corner of fixed rail section 142, remain open while a finger 420 is fixedly secured in the lower seat, such as seat 406, of rail 142 (FIG. 5) with the taper of body portion 426 facing upwardly. The respective cooperation of the fingers 420 with the seats 404, 406 will be further explained with the operation of switch 90 with reference to FIGS. 5 through 10.

A crank lever 460 (FIGS. 2 and 3) is fixedly secured to cam rod 260 for conjoint rotation therewith; while a similar crank lever 462 is fixedly secured to cam rod 290 for conjoint rotation therewith and in alignment with lever 460. A connecting rod 464 is pivotally connected at 466 to lever 460 and at 468 to lever 462 so that rocking movement of rod 260 is transmitted through lever 460 to rod 464 and then to lever 462 and rod 290. Also fixedly connected to cam rod 260 for conjoint rocking movement is one end of a crank arm 480 the other end of which is pivotally connected at 482 to a rod 484 of a cylinder 490 pivotally secured by suitable means, such as a clevis pin 492, to cross-beam 106. Cylinder 490 is fluid operated with suitable and conventional supply and control of air or hydraulic fluid as the operating medium.

Diversion switches 90 are positioned, as previously described, at locations within track arrangement 32 where a carrier 50 traveling along rail arrangement 32 is to be directed from a first pathway to another pathway or onto a spur. Thus, a switch 90 may be positioned as at position 500 (FIGS. 1 and 5) where at a carrier 50 traveling along rail arrangement 32 may either proceed straight ahead in the direction of arrow 502 or curve off to the left in the direction of arrow 504. Switch 90 may also be constructed and disposed to accommodate a position in rail arrangement 32 such as position 510 (FIG. 1) where at a carrier 50 could move either straight ahead in the direction of arrow 512 or to the right in the direction of arrow 514; or a switch 90 may be positioned at a location 520 where at a carrier 50 could move either on a curve to the right as indicated by arrow 522 or a curve to the left as indicated by arrow 524. A switch 90 to accommodate a position such as that at 510 would be constructed similar to the one shown in FIGS. 2–10 but with the relative positions of straight shiftable rail section 370 and curved shiftable rail section 398 reversed and with rail section 398 curved in the opposite direction to that shown in FIGS. 2–10. The positions and attachment to frame assembly 92 of fixed rail section 114, 116 and 142 would be positioned for cooperation with the appropriate shiftable rail sections. A switch 90 to accommodate a position such as 520 would replace the straight-shiftable rail section 370 with a curved shiftable rail section such as section 398 but curved in the direction opposite to that of rail section 398. Fixed rail section 114 would be replaced by a fixed rail section of a configuration similar to that of fixed rail section 142 but disposed like a mirror image to that of section 142 for cooperation with a right curving shiftable rail section. Switch 90 is thus disposed at the junction where separate pathways, such as 502, 504 merge together to form a common pathway for at least a portion of rail arrangement 32 (i.e. that portion of rail arrangement 32 leading up to fixed rail section 116 may be regarded as a merged common 502/504 pathway). Alternatively, switch 90 may be considered to be disposed where common or merged pathways separate into distinct and separate pathways. Switch 90 functions in such instances to establish either pathway 502 or pathway 504 as a continuous pathway.

In all such arrangements for switch 90 the operation thereof to move either one or the other of the shiftable rail sections into position to form the continuous pathway will be the same as for switch 90 shown in FIGS. 2-10 and thus the following description of the operation thereof will suffice for all possible arrangements for a diversion switch such as switch 90.

FIGS. 5 and 6 show switch 90 at position 500 (FIG. 1) with shiftable rail section 370 completing rail conveyor pathway 502 (FIGS. 1 and 5) of rail arrangement 32; while FIGS. 9 and 10 show switch 90 at position 500 with shiftable rail section 398 completing rail conveyor pathway 504 of rail arrangement 32. FIGS. 7 and 8 show switch 90 in a position intermediate that of the positions shown in FIGS. 5 and 6 and that of FIGS. 9 and 10. Switch 90 will normally either be disposed to complete pathway 502 or pathway 504 and will only be in the FIGS. 7 and 8 position during the process of being shifted between said two pathway completing positions. Article carrier 50 (FIG. 1) will usually enter switch 90 in the direction of arrow X (FIGS. 5, 7 and 9) and exit in the direction of either arrow X (FIG. 5) or arrow Y (FIG. 9) depending upon which rail conveyor pathway is completed. However, switch 90 is also operative for a carrier 50 entering switch 90 in directions opposite to the directions of arrows X or Y. If the rail conveyor pathway along which a carrier 50 so enters is complete then the carrier 50 will pass through switch 90. Should the pathway be not complete, as it would be for example if a carrier 50 were entering switch 90 at fixed rail section 142 in the FIG. 5 position of switch 90, then a stop of conventional construction not shown carried by the shiftable portion of switch 90 will have been moved into position to prevent entry of carrier 50 into switch 90. A similar stop (not shown) would prevent entry of a carrier 50 into switch 90 along pathway 502 from the direction of fixed rail section 114 when switch 90 is in the FIG. 9 position; while both such stops, and a similar stop proximate fixed rail section 116 prevent entry of a carrier 50 into switch 90 while in its intermediate position (FIG. 7).

Operation of switch 90 is affected under suitable and conventional controls actuated under computer or manual control. It is assumed: that a carrier 50 is approaching switch 90 along pathway 502 of rail arrangement 32 so as to enter switch 90 in the direction of arrow X at fixed rail section 116; that switch 90 is in its FIG. 5 disposition; and that carrier 50 is to exit switch 90 along pathway 504 in the direction of arrow Y at fixed rail section 142. When switch 90 is in its FIG. 5 position: cylinder rod 484 of fluid cylinder 490 is fully retracted; cam follower assembly 262 is oriented with its cam follower roller 270 (FIGS. 3 and 6) in space 182 between rails 170, 172, and with its roller 271 on surface 282 of rail 170 proximate cam surface 212; cam follower assembly 264 (FIG. 3) is oriented with its cam follower 270 in space 202 between rails 190, 192 and with its roller 271 on surface 280 of rail 190 proximate cam surface 220; cam follower assembly 292 (FIGS. 3 and 6) is oriented with its cam follower roller 270 over the end of cam rail 172 and with its roller 271 on surface 296 of rail 172 proximate cam surface 216; cam follower assembly 294 (FIG. 3) is oriented with its cam follower roller270 over the end of cam rail 192 and with its roller 271 on surface 298 of rail 192 proximate cam surface 224.

At the appropriate time switch 90 is activated by energizing fluid cylinder 490 to effect movement of cylinder rod 484 in the direction of arrow R (FIG. 5). The initial movement of rod 484 will cause cam follower rollers 271 of all the cam followers to ride along surfaces 280, 282, 296, 298 of rails 190, 170, 172 and 192 respectively and cam follower rollers 270 to ride up over curved cam surfaces 212, 216, 220 and 224 respectively of cam rails 170, 172, 190 and 192. This action will raise cam rods 260 and 290 and beams 320 and 330 carried thereby which through rail support arms 350, 356 will raise shiftable rail 370 and through rail support arms 390, 394 will raise shiftable rail 398.

Shiftable rails 370 and 398 are raised a sufficient amount to withdraw body portions 426 of fingers 420 carried by shiftable rail 370 out from upper finger seats 404 in fixed rail sections 114, 116. At the same time the raising of shiftable rail section lifts its finger seats 406 off of fingers 420 extending out from lower finger seats 406 of fixed rail sections 114, 116.

Continued extension of cylinder rod 484 in the direction of arrow R moves shiftable rail sections 370 and 398 in the direction of arrow R (FIGS. 7 and 8) until cam follower rollers 271 ride down curved cam surfaces 210, 214, 218 and 222 of cam rails 170, 172, 190 and 192 respectively so that cam follower rollers 271 of cam followers 292 and 294 fall into spaces 182 and 202 respectively and cam follower rollers 270 of cam followers 262 and 264 fall in front of cam rails 170 and 190 respectively. With that action fingers 420 disposed at the top of shiftable rail 398 are aligned with and move into finger seats 404 formed at the top of fixed rails 116 and 142 respectively while finger seats 406 formed at the bottom of rail 398 align with and onto fingers 420 extending from the bottoms of rails 116 and 142 respectively.

The configuration of fingers 420 and seats 404, 406 and any downwardly directed load forces due to the weight of shiftable rail section 398, or other members of switch 90 directed through rail section 398, facilitates any final alignment and positioning of shiftable rail 398 with fixed rails 116 and 142, (or of shiftable rail 370 with fixed rails 114, 116) if needed, so that finger surfaces 424 form a continuous and smooth path between the adjacent rail surfaces. In addition, the cooperation of shiftable rail 398 and fixed rails 116, 142 (or of shiftable rail section 370 and fixed rails 114, 116) through fingers 420 and seats 404, 406 acts to transfer loads acting on shiftable rail section 398 through fixed rail section 116, 142 (or of shiftable rails section 370 through fixed rail sections 114, 116) and thereby to the adjacent rails of rail arrangement 32 and their support structure rather than the support structure of switch 90.

Operation of switch 90 to return shiftable rail section 370 into alignment and coaction with fixed rail sections 114, 116 (FIG. 5) is accomplished by energizing fluid cylinder 490, as previously accomplished, to draw cylinder rod 484 in the direction of arrow "S" (FIG. 5). The return movement of rod 484 will cause cam follower rollers 270 and 271 to retrace their respective rolling movements with respect to cam rails 170, 172, 190 and 192: to thus raise shiftable rails 370 and 398; to maintain shiftable rails 370 and 398 raised until rail 370 is again in alignment with fixed rails 114, 116; and to lower shiftable rails 370 and 398 so that fingers 420 carried by rail 370 seat in seats 404 of fixed rails 114, 116 and so that seats 406 of shiftable rail 370 seat on fingers 420 carried by fixed rail sections 114, 116.

Figure 11:
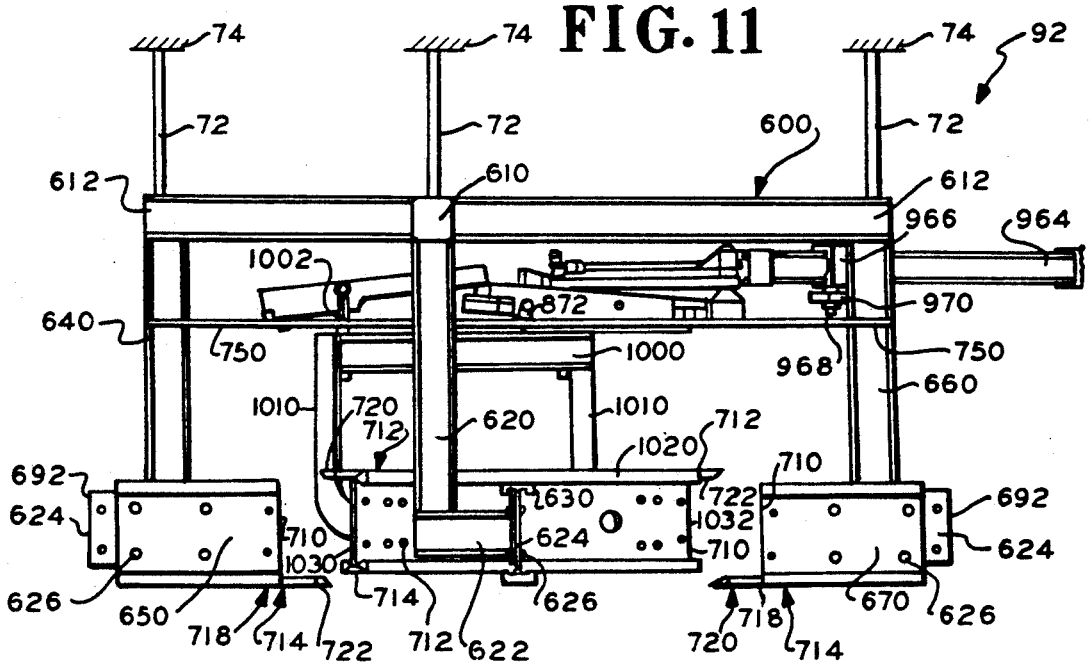
FIG. 11 is an elevation view of a cross-over switch of the rail conveyor system of FIG. 1 showing same in a position which is not completing a pathway to better shown details thereof.
Figure 12:
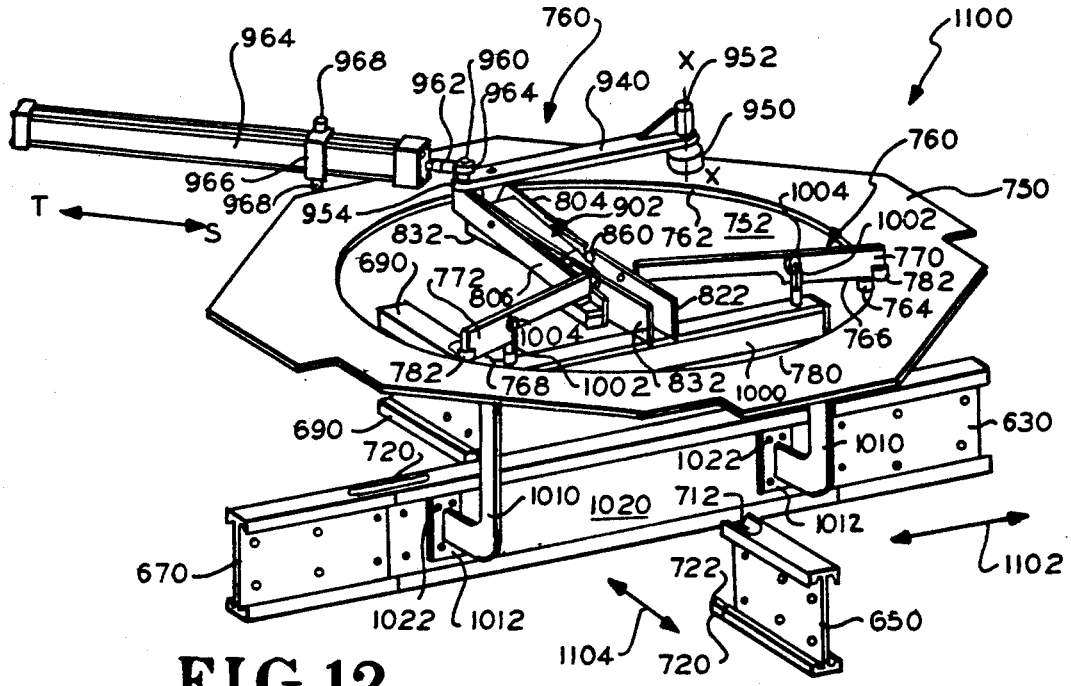
FIG. 12 is a perspective view of the switch of FIG. 11 viewed from a different direction and with support members removed to better shown details thereof and shown in position for completing a third rail conveyor pathway.

Each switch 92 (FIGS. 11-18), like switches 90, includes a support assembly 600 (FIG. 11) fixedly secured in position with respect to fixed portions of rail arrangement 32 by suitable and appropriately disposed switch mounting supports. Such mounting supports might include floor mounted supports, overhead support members 72 or side supports, such as supports 76 (FIG. 1). A suitable number of overhead supports 72 (FIG. 11) extend down from a fixed overhead support mounting, such as ceiling 74, and are suitably connected as by fasteners (not shown) to cross-beams 610 and 612 of support assembly 600. A support post 620, fixedly connected at one of its ends to beam 610, proximate one end thereof, by suitable means such as welding or the like, extends down from beam 610 and has mounted at its other end, as by welding, one end of a horizontally extending support beam 622 the other end of which mounts by welding, or the like, a connector plate 624. Connector plate 624 is similar to and serves the same purposes as connector plate 127 of switch 90 in that it, in turn, has secured thereto as by threaded fastening means 626 a fixed rail section 630 (FIG. 11 and 12). In similar manner a support post 640 (FIG. 11) is secured at one of its ends to cross-beam 612 and has secured to its other end a horizontally extending support beam (not shown) similar to beam 622 which carries at its free end a connector plate 624 to which is secured, by fasteners 626, a fixed rail section 650 (FIG. 11 and 12). A support post 660 (FIG. 11) is likewise secured at one of its ends, as by welding, to cross-beam 612, at an end thereof opposite to post 640. A horizontally extending support beam (not shown) similar to beam 622 (and to the support beam extending from post 640) extends from a lower end of post 660 and mounts a connector plate 624 (as by welding or the like). A plurality of fastening means 626 connect a fixed rail 670 (FIG. 11 and 12) to the beam at the lower end of post 660 (FIG. 11). Another post (not shown) extends vertically down from the end of cross beam 610 in a manner similar to post 620. That other post is secured at one of its ends to beam 620 and has secured, as by welding, to its other end a horizontally extending support beam (not shown), similar to beam 622, and which has mounted at its free end a connector plate 624 (not shown) to which is fastened by fasteners 626 (not shown) a fixed rail 690, (FIG. 12). All connector plates 624, extend beyond the ends of fixed rail sections 630, 650, 670, and 690 and are used to interconnect the fixed rail sections to adjacent rails of rail arrangement 32 by the use of fastening means such as fasteners 626.

Each fixed rail section 630, 650, 670, and 690, at an end 710 thereof, has formed to extend in from an upper corner a finger locating seat 712 (FIG. 12) of a size and configuration and for the same purpose as seat 404 (FIG. 4A) of switch 90. A seat 714 (FIG. 11), which extends in from a lower corner of end 710 of fixed rail sections 630, 650, 670 and 690, is of size and configuration as seat 712 and for the same purpose and corresponds in size, configuration and purpose as finger seats 406 (FIG. 4A) of switch 90.

Fixedly secured within each finger seat 714, by suitable fastening means such as fasteners 422 (FIG. 4A), is one end 718 (FIG. 11) of a rail locating and load transmitting finger 720 the other end 722 of which extends out from end 710 of each such fixed rail section. Fingers 720 are of a size and configuration identical to that of fingers 420 (FIG. 4A) of switch 90, and serve the same purpose and function as described above for fingers 420 of switch 90.

A switch operating mechanism mounting plate 750 (FIGS. 11 and 12) is fixedly secured, as by welding or the like, to posts 620, 640, 660 and the one other similar post (not shown). A relatively large circular opening 752 (FIG. 12) is formed in plate 750 of a size and disposition to coact with an operating mechanism 760 (FIG'S. 12 and 13) for switch 92.

A surface 762 of the wall defining opening 752 coacts with cam rollers 764 (FIGS. 12, and 13) each of which is rotationally mounted, by suitable means, beneath outer ends 766, (FIGS. 12 and 13) and 768 of arms 770, 772 respectively of switch operating mechanism 760 to guide the movement thereof. Cam rollers 764 are similar in operation to rollers 270, 271 (FIG. 4). Upper surface 780 (FIG. 12) of plate 750, proximate opening 752, forms a support surface for rolling support means 782 (FIGS. 12 and 13) each of which is also carried at outer ends 766 (FIGS. 12 and 13) and 768 respectively of arms 770, 772. Each rolling support means 782 is in the form of a conventionally available ball transfer and is secured to its respective arm (770, 772) with the freely rolling transfer ball facing down and disposed for rolling contact upon surface 780 of plate 750. The other end 786 and 788 respectively of arms 770 and 772 carry rolling support means 792, which are also ball transfers identical in construction to rolling support means 782, and are disposed for rolling contact upon a planar surface formed in slots 794 796 respectively in blocks 798 (FIG. 13) carried at an end 800 of an outer operating frame 802.

Outer operating frame 802 is substantially "U" shaped in configuration with spaced side walls 804 (FIG. 13) and 806 (FIGS. 13 and 14) which are open top and bottom and at the end where blocks 798 are mounted and which are connected at their other end by an end wall 808. A lip 810 extends out from end wall 808 and mounts a rolling support means 782 (FIG. 14) in the form of a ball transfer with its freely rolling ball disposed to roll along plate surface 780. A cam roller 764 is also rotatively mounted to end wall 808 for rolling contact with surface 762 of plate 750. A first pivot 820 (FIG. 13) pivotally interconnects side wall 804 with a side wall 822 of an inner operating frame 824; while a second pivot 830 pivotally interconnects side wall 806 with a side wall 832 of inner operating frame 824. Inner operating frame 824 is also substantially "U" shaped in configuration with side walls 822 and 832 thereof spaced one from the other, open top and bottom and at an end 834 and with an end wall 836 (FIGS. 13 and 14) connecting walls 822 and 832 together at their other ends. Suitable spacing members 840 (FIG. 14 only two shown) are disposed between walls 804 and 822 and between walls 806 and 832 to provide suitable separation there between. Spacing members 840 may be suitably carried by one wall and provide an appropriate bearing surface with the facing wall. A lower camming roller 850 (FIG. 14) is rotatively carried by a shaft 852 spanning and mounted between walls 822 and 832, of inner operating frame 824, while an upper camming roller 860 (FIG. 13 and 14) is rotatively carried by a shaft 862 spanning and mounted between walls 804, 806, of outer operating frame 802. Wall 832 is notched at 870 (FIG. 14) and wall 822 is notched in a position corresponding to notch 870 to facilitate disposition of roller 860. Suitable notches 872 (FIGS. 11 and 15) are provided in lower edge of walls 804, 806, of outer operating frame 802 to accommodate the mounting of lower camming rollers 850 (FIGS. 13 and 14).

Figure 13:
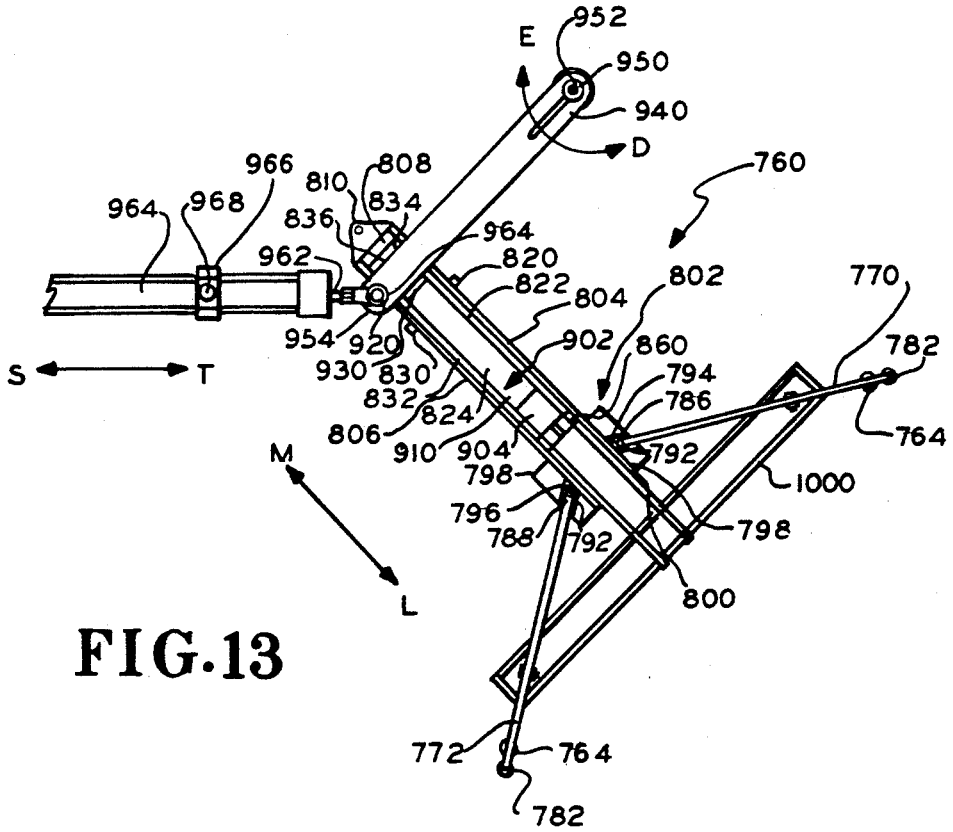
FIG. 13 is a plan view of the operating mechanism of the switch of FIGS. 11 and 12 showing same in its FIG. 12 position.
Figure 14:
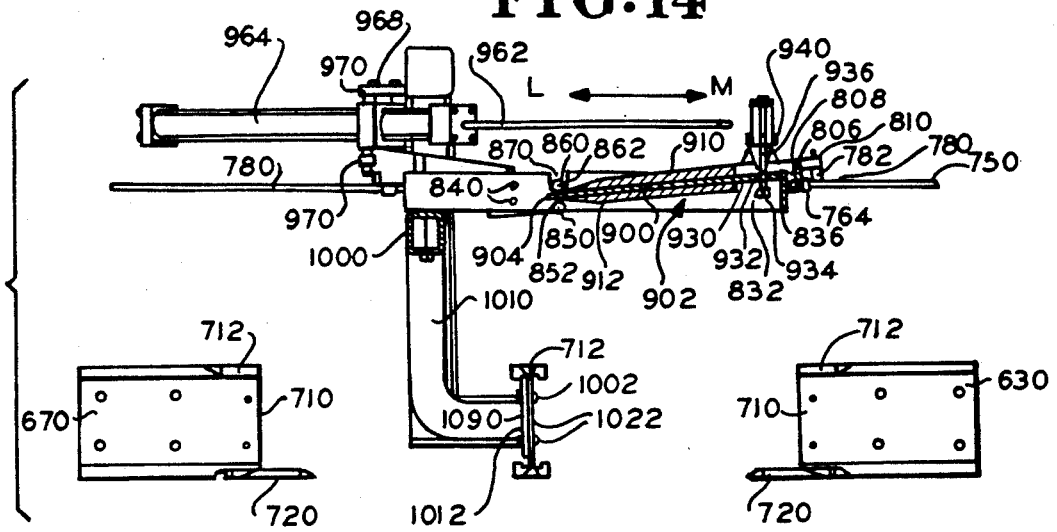
FIG. 14 is an elevation view, in partial section, of the switch of FIGS. 11 and 13 but showing same in position for completing of fourth rail conveyor pathway.

A center plate 900 of operating cam 902 includes a front lip 904 which, in the positions of cam 902 shown in FIGS. 13 and 14, is disposed between and spaces upper camming roller 860 and lower camming roller 850. An upper camming surface 910 is secured by suitable means to an upper surface of center plate 900 and a lower camming surface 912 (FIG. 14) is secured by suitable means to a lower surface of outer plate 900. A rear lip 930 of cam 902 (FIGS. 13 and 14) extends beyond ends of camming surfaces 910, 912 and mounts a spherical ball joint 932 through which passes a bolt 934 which extends upwardly therefrom through a conical space 936 and terminates in an operating arm 940 (FIGS. 12 and 14). Cam 902 is thus mounted within inner operating frame 824 for relative movement with respect hereto in the directions of arrows "L" and "M" (FIG. 14).

A first end 950 (FIGS. 12 and 13) of operating arm 940 is pivotally mounted at 952 to plate 750 for swinging movement about a vertical axis "X—X" (FIG. 12) while a second end 954 (FIGS. 12 and 13) of arm 950 is rotationally and rockably connected to an end 960 of a cylinder rod 962 by means of a ball type joint 964. Cylinder rod 962 is conventionally carried by a fluid cylinder assembly 964 which, in turn, is carried by a trunion type mounting 966 which includes a pair of pins 968 (FIG. 12) extending out therefrom and each pivotally mounted in suitable bearings (not shown) in opposed and spaced plates, such as plate 970 (FIG. 11) attached to post 660 by suitable means such as welding, or the like. Cylinder 964 is secured within trunion 966 by appropriate means which prevent relative movement between cylinder 964 and trunion 966, but cylinder 964 and trunion 966 can rotate about a vertical axis passing through pins 968. Cylinder 964 is fluid operated, like cylinder 490 of switch 90, with suitable and conventional supply and control of air or hydraulic fluid as the operating medium.

End 834 of inner operating frame 824 is fixedly secured, as by welding or the like, to the top of a shiftable, or rotatable, beam 1000 (FIGS. 11 thru 18) at a location mid-way between the ends thereof. Extending upwardly from the top of beam 1000, proximate each end thereof, is a clevis 1002 (FIGS. 12 and 13), one of which, pivotally receives switch arm 770 and the other of which pivotally receives switch arm 772; with both arms 770, 772 pivotally mounted between the spaced legs of clevis's 1002 by pivot pins 1004 (FIG. 13). Extending downwardly from the bottom of beam 1000, proximate each end thereof, are a pair of spaced rail support arms 1010 (FIGS. 11 and 12) each of which has secured to the end thereof, as by welding, a rail mounting plate 1012 (FIG. 12). A shiftable, or rotatable rail 1020 (FIGS. 11 and 12) is secured to mounting plates 1012 by suitable means such as threaded fasteners 1022.

Shiftable rail 1020, at ends 1030 and 1032 (FIGS. 11 and 17) thereof, has formed to extend in from each upper corner a finger locating seat 712 and from each lower corner a finger locating seat 714. Seats 712 and 714 are identical in configuration and purpose with seats 712 and 714 of fixed rails 630, 650, 670, and 690 which, in turn, are identical in configuration and purpose with finger seats 404, 406, (FIG. 4A) of switch 90. Fixedly secured within each finger seat 712 of rail 1020, by suitable means such as fasteners 422 (FIG. 4A), is one end of a rail locating and load transmitting finger 720 (FIGS. 11 and 17) the other end 722 of which extends out from ends 1030 and 1032 of rail 1020. Fingers 720 are of a size and configuration identical to that of fingers 720 secured to fixed rails 630, 650, 670 and 690 which, in turn, are identical to that of fingers 420 (FIG. 4A) of switch 90, and serve the same purpose and function as described above for other fingers 720 and for fingers 420 of switch 90.

Cross-over switches 92 are positioned, as previously described, at locations within track arrangement 32 where a carrier 50 traveling along rail arrangement 32 has to cross another section of rail arrangement 32. Thus, a switch 92 may be positioned at position 1100 (FIGS. 1 and 12) where at a carrier 50 traveling along rail arrangement 32 may either be proceeding in the direction of arrow 1102 or in the direction of arrow 1104. Since the rails of rail arrangement 32 at position 1100 are at the same level only one such pathway can be used of a time and switch 92 is shiftable, or rotatable between both of such pathways to accommodate the movement of the carrier. Switch 92 is shown for rail pathways that intersect at ninety degrees, however it should be obvious that with relatively minor modifications switch 92 can be reconstructed to accommodate rail pathways that intersect at angles greater and/or less than ninety degrees.

Figure 17:
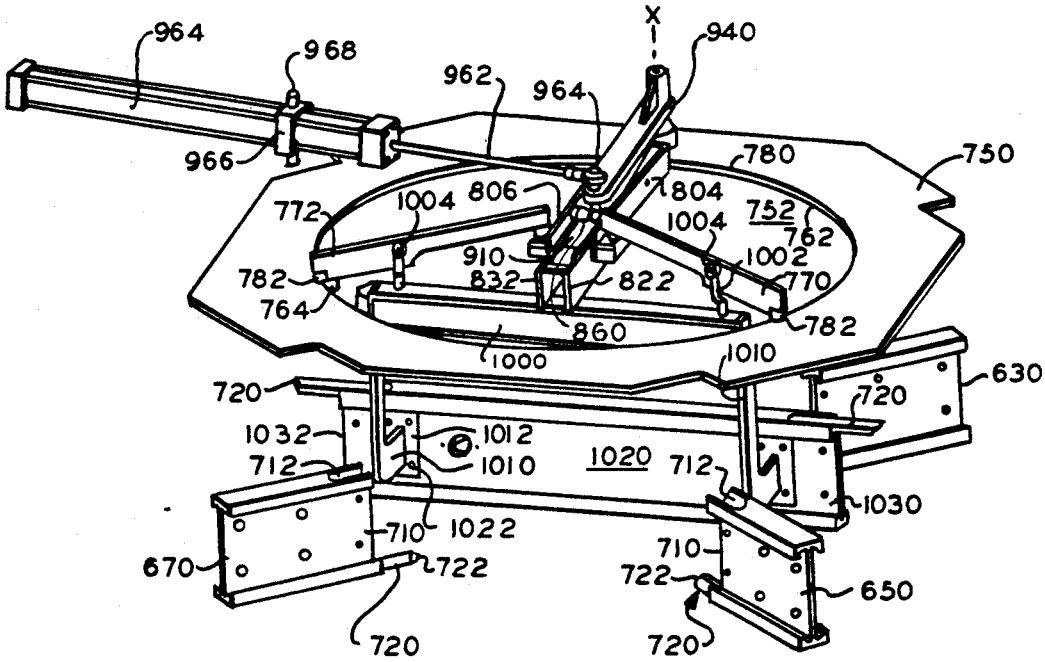
FIG. 17 is a perspective view of the switch of FIG. 11 and 16 shown in a position intermediate to the third rail conveyor pathway of FIG. 12 and the fourth rail conveyor pathway of FIG. 14.
Figure 15:
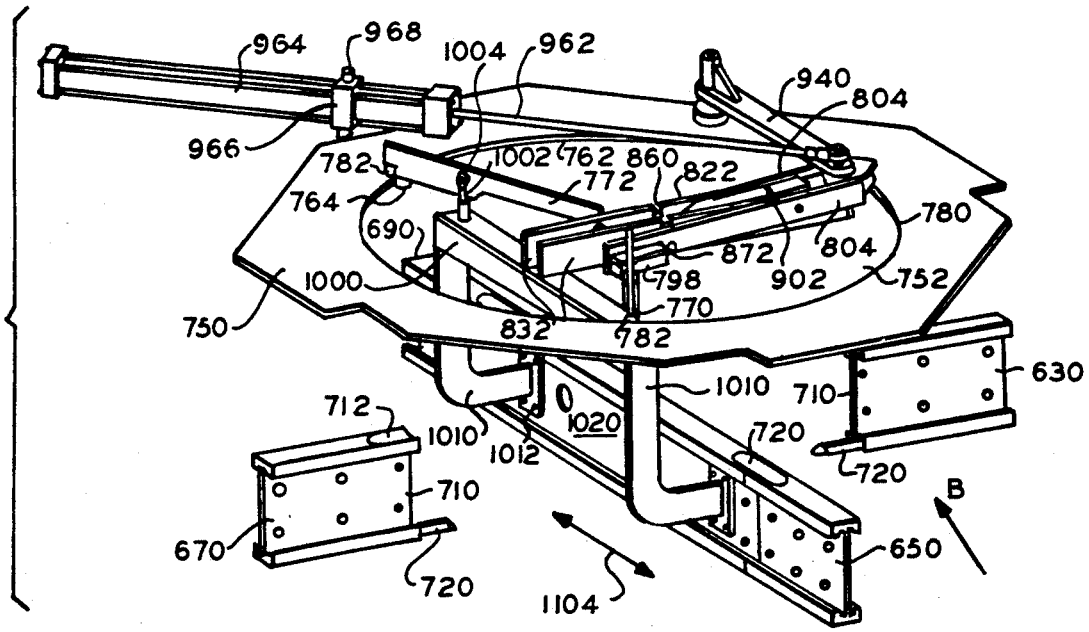
FIG. 15 is a perspective view of the switch of FIG. 14.

FIG. 12 shows switch 92 at position 1100 (FIG. 1) with shiftable or rotatable rail section 1020 completing rail conveyor pathway 1102 (FIG. 12) of rail arrangement 32; while FIGS. 14, 15 and 16 show switch 92 at position 1100 with rail section 1102 completing rail conveyor pathway 1104 of rail arrangement 32. FIGS. 11, 17, and 18 show switch 92 with rail section 1020 in a position intermediate that of the positions shown in FIG. 12 and that of FIGS. 11, 17 and 18. Switch 92 will normally either be disposed to complete pathway 1102 or pathway 1104 and will only be in the FIGS. 11, 17 and 18 position during the process of being shifted between said two pathway completing positions. Article carrier 50 (FIG. 1) may enter switch 92 in either direction along pathway 1102 depending upon which rail conveyor pathway is completed and continuous. If the rail conveyor pathway along which a carrier 50 so enters is complete then the carrier 50 will pass through switch 92. Should the pathway be incomplete, as it would be for example if a carrier 50 were entering switch 92 at fixed rail section 650 in the FIG. 12 position of switch 92, then a stop of conventional construction (not shown) carried by the shiftable portion of switch 92 will have been moved into position to prevent entry of carrier 50 into switch 92. A similar stop (not shown) would similarly prevent entry of a carrier 50 into switch 92 along pathway 1104 from the direction of fixed rail section 670 when switch 92 is in the FIG. 12 position. Similarly disposed and operative stops would prevent entry of a carrier 50 into switch 92 along pathway 1102 from the direction of either fixed rail section 630 or fixed rail section 670 when switch 92 is in its FIG. 15 position completing pathway 1104. All of such stops are operative to prevent entry of a carrier 50 into switch 92 while in its intermediate position (FIGS. 11, 17 and 18).

Operation of switch 92 is effected under suitable and conventional controls actuated under computer or manual control. It is assumed: that a carrier 50 is approaching switch 92 along pathway 1102 of rail arrangement 32 so as to enter switch 92 from the direction of fixed rail section 630 (FIG. 12) that switch 92 is in its FIG. 12 disposition; and that carrier 50 is to exit switch 92 along pathway 1102 by passing over fixed rail section 670. When switch 92 is in its FIG. 12 position: cylinder rod 962 of fluid cylinder 964 is fully retracted; and if the other members of the operating mechanism 760 of switch 92 are disposed as shown in FIGS. 12 and 13 with outer operating frame 802 and inner operating frame 824 disposed in vertical orientation as shown in FIG. 16 (which in actuality corresponds to the FIG. 15 disposition of the switch operating mechanism; 760) cam 902 is disposed proximate end wall 836 of inner operating frame 824 with its lip 904 between camming rollers 850, 860; and operating arm 940 is positioned as shown in FIGS. 12 and 13 with its end 954 in relatively close proximity to the face of cylinder 964.

At the appropriate time and in response to suitable controls switch 92 is activated by energizing fluid cylinder 964 to effect movement of cylinder rod 962 in the direction of arrow T (FIGS. 12 and 17) with respect to fluid cylinder 964 swinging movement of operating arm 940 in the clockwise direction of arrow "D" (FIG. 13) about its vertical axis of rotation X—X (FIG. 12). The coaction of cylinder rod 962 with arm 940 and the mounting of fluid cylinder 964 by means of trunion 966 for rotation about pins 968 induces firstly a counter clockwise rotation (FIG. 13) of fluid cylinder 964 about a vertical axis of rotation through pins 968; and thereafter a counter-clockwise rotation thereof about said axis of rotation; while the coaction of arm 940 with operating cam 902 through bolt 934 effects a movement of cam 902 in the direction of arrow "L" with respect to inner operating frame 824 (FIG. 14). Such movement of cam 902 will move upper camming surface 910 and lower camming surface 912 into coaction with upper camming roller 860 and lower camming roller 850 respectively inducing a separation thereof sufficient to permit the thickest portion of cam 902 to enter between and move in the direction of arrow "L" between rollers 850, 860. As this occurs outer operating frame 802 will pivot upwardly and in a clockwise direction about the point where the ball member of its rolling support beams 782 rests upon surface 780 of plate 750 raising with it pivots 820 and 830 (FIGS. 12 and 13) and inner operating frame 824 through the coaction of pivots 820, 830, with side walls 822, 832 of frame 824. The configuration and disposition of the members of operating mechanism 760 is such that as inner operating frame 824 is so moved upwardly its connection to beam 1000 and the connection to beam 1000 of arm 770, 772 through clevis's 1002 results in a substantially vertical movement of shiftable rail 1020 (FIGS. 12, 14, and 15). The extent of vertical movement of rail 1020 is selected so that fingers 720 (FIGS. 11 and 12), carried at the ends thereof, move up out of seats 712 so that the bottom of fingers 720 clear the tops of fixed rails 630, 670. Such vertical movement of rail 1020 will also raise seats 714 formed at the lower ends thereof off of fingers 720 projecting out from the lower ends of fixed rails 630, 670.

The movement of cylinder rod 962 in the direction of arrow "T" (FIG. 13), the induced rotation of arm 940 in the direction of arrow "D", and the coaction of arm 940 through bolt 934 with inner operating frame 824 and outer operating frame 802 also results in a rotation of all the members of operating mechanism 760 shown in FIG. 13 (except fluid cylinder 964, trunion 966 and rod 962) in the clockwise direction about a vertical axis of rotation through the center of opening 752 of plate 750. The rolling action of rolling support means 782 carried by outerframe 802 and arms 770 and 772 upon surface 782 of plate 750 and of rollers 764 upon surface 762 facilitate and guide the rotation of operating mechanism 760. As operating mechanism 760 so rotates shiftable rail section 1020 moves in rotational manner from its position completing rail conveyor pathway 1102 (FIG. 12) through the intermediate position of FIGS. 11, 17 and 18 and into its position completing rail conveyor pathway 1104 (FIGS. 14, 15, and 16). Operating mechanism 760 so moves rail section 1020 in a harmonic manner accelerating upon initial movement as rail section 1020 lifts out of its position of alignment with fixed rails 630 and 670, decelerating in a harmonic manner as rail section 1020 moves into its position of alignment with fixed rail sections 650, 690.

The configuration of the members of operating mechanism 760 is also such that as it passes through a mid point due to the extension of cylinder rod 962 from cylinder 964 cam 902 will reach the extent of its travel in the direction of arrow "L" and will move in the direction of arrow "M" back into its position proximate end wall 836 of inner operating frame 824. As camming surfaces 910 and 912 move out from between camming rollers 860 and 850 respectively rollers 860 and 850 will be moved towards each other resulting in a pivoting of outer operating frame 802 in the counter clockwise direction about the point where the ball member of its rolling support means 782 rests upon surface 780 of plate 750. Inner frame 824, through its coaction with outer frame 802, will be lowered as will beam 1000 and shiftable rail section 1020. The lowering of shiftable rail section will occur, in time sequence, as cylinder rod 962 reaches the extent of its extension from cylinder 964 and as operating arm 940 completes its rotation in the direction of arrow "B" (FIG. 13) and moves into its FIG. 15 position. This timing is such that fingers 720 of shiftable rail section 1020 will move into alignment with seats 712 of fixed rail sections 650 and 690 and seats 714 of rail section 1020 will move into alignment with fingers 720 of fixed rail sections 650, 690. As rail section 1020 is lowered fingers 720 and seats 712, 714 will cooperate to align shiftable rail section 1020 with fixed rail sections 650 and 690 to form a continuous rail conveyor pathway with a smooth upper rail surface.

The configuration of fingers 720 and seats 712, 714 and any downwardly directed load forces due to the weight of shiftable rail section 1020 facilitate any final alignment and positioning of shiftable rail 1020 with fixed rails 650, 690, (or 630 and 670), if needed, so that the smooth finger surface will form a continuous and smooth path with the adjacent fixed rail surfaces. In addition, the cooperation of shiftable rail 1020 and fixed rails 650, 690, (or 630 and 670) through fingers 720 and seats 712, 714 acts to transfer loads acting on shiftable rail section 1020 through fixed rail section 650, 690 (or 630 and 670) and thereby to the adjacent rails of rail arrangement 32 and their support structure rather than the support structure of switch 92.

Shiftable rail section 1020 is moved from its position forming a continuous pathway with fixed rail sections 650, 690 into a position forming a continuous pathway with fixed rail sections 630, 670 by drawing cylinder rod 962 in the direction of arrows "S" (FIG. 12) back into fluid cylinder 964. Operating arm 940 will be rotated in the counter clockwise direction of arrow "E" (FIG. 13) from its FIG. 15 position towards and into its FIG. 12 position. Cam 902 will move first between rollers 850 and 860 and then out from between rollers 850 and 860 as described above for the shifting of rail section 1020 into cooperation with fixed rails 650, 690. Beam 1000 and shiftable rail section 1020 will be raised, rotated (but in the opposite direction) and then lowered as described above and shiftable rail section 1020 will be moved from its position of cooperation with fixed rails 650, 690 back into its position of cooperation with fixed rails 630, 670.

It should be understood that although switches 90 has been shown carrying fixed rail sections 114, 116, and 142 and that although switch 92 has been shown carrying fixed rail sections 430, 450, 470 and 490 that either or both of them switch may be built without fixed rail sections or with only some of same. When such fixed rail sections are not carried by the respective switch they may instead be fixed only to the adjacent and pertinent rail portions of rail arrangement 32. Alternately the adjacent rail portions of rail arrangement 32 would have the pertinent finger seats (404, 406, or 712, 714) formed therein and the appropriate fingers 420 or 720 carried thereby. The switch would still include the appropriate shiftable rail section or sections with fingers and finger seats.

From the above description it will thus be seen that there has been provided new and improved rail conveyor switches and rail conveyor which incorporate such switches; which switches utilize load forces generated by and acting through shiftable rail sections of the respective switches and specially configured load transmitting fingers and cooperating seats to facilitate alignment of the shiftable rail section with cooperating fixed rail sections to selectively establish a predetermined continuous rail conveyor pathway; and to transmit load forces acting upon such shiftable rail section, when so positioned, to the fixed rail sections.

It is understood that although I have shown the preferred embodiments of my invention that various modifications may be made in the details thereof without departing from the spirit as comprehended by the following claims.

What is claimed is:

1. A rail conveyor; comprising:

(a) a rail arrangement including at least a first rail conveyor pathway and a second rail conveyor pathway;

(b) said first rail conveyor pathway and said second rail conveyor pathway meeting at at least one predetermined location whereat each of said rail conveyor pathways is discontinuous by having the rails thereof separated from each other end to end;

(c) rail switch support means mounting rail switch means at said predetermined location;

(d) said rail switch support means mounting said rail switch means for movement between a first position wherein said rail switch means coacts with and establishes said first rail pathway as a continuous rail pathway and a second position wherein said rail switch means coact with and establishes said second rail pathway as a continuous rail pathway;

(e) operating means carried by said rail switch support means for shifting said rail switch means between said first position and said second position; and (f) at least one rail cooperating means disposed for coaction with said rail switch means and separated rails of the rail pathways which the rail switch means is to coact with;

(g) each of said rail cooperating means to include, a body member of predetermined external configuration carried either by said rail switch means or a rail of the rail pathway with which said rail switch means will coact, and, a body seat of a configuration corresponding to at least a portion of said external configuration of said body member and carried by either said rail switch means or the rail of the rail pathway with which said rail switch means will coact, whichever of same is not carrying said body member;

(h) said predetermined configuration of said body member and said predetermined configuration of said body seat being such that when said body member and said body seat are disposed for coaction with each other that load forces applied to said rail switch means will effect an alignment of said rail switch means with the separated rails of the rail pathway which said rail switch means is to coact with to render the pathway continuous, and will transfer loads applied to said rail switch means directly to the separated rails of the rail pathway which said rail switch means is to coact with and any support structure therefor.

2. The rail conveyor of claim 1, wherein:

(a) said rail switch means includes at least one shiftable rail section of a predetermined length and linear configuration having upper and lower surfaces and terminating at first and second ends which are to be disposed respectively in close proximity to cooperating ends of the separated rails with which said shiftable rail section is to coact and those rails have upper and lower surfaces; and (b) at least one of said rail cooperating means is disposed between one of said ends of said shiftable rail section and one of said cooperating ends of the separated rails with which said shiftable rail section is to coact.

3. The rail conveyor of claim 2, wherein a rail cooperating means is disposed at least between each of said ends of said shiftable rail section and each of said cooperating ends of the separated rails with which said shiftable rail section is to coact.

4. The rail conveyor of claim 3, wherein said body member of each of said rail cooperating means is in the form of a finger-like object one end of which is secured to either said shiftable rail section or the rail with which said shiftable rails section coact so that at least a predetermined portion of said finger extends outwardly therefrom towards the other of said shiftable rail section or the rail with which said shiftable rail section coact whichever is not carrying said body member and said body seat is of a size and configuration to receive said predetermined finger portion and is carried by the other of said shiftable rail section or the rail with which said shiftable rail section coact whichever is not carrying said body member.

5. The rail conveyor of claim 4, wherein said finger-like object includes a flat surface and a body section having ends, sides and a top rising from said flat surface with an inward taper along said sides and ends from said flat surface towards said top and said body seat is formed with sides and at least one end with tapers of a size and configuration to cooperate with those of said finger-like object.

6. The rail conveyor of claim 5, wherein said ends of said finger-like object are in the configuration of frustums of semi-cones and said sides are elongated between said ends and terminate in said top which is relatively flat and disposed in a plane parallel to a plane in which said flat surface is disposed in.

7. The rail conveyor of claim 3, wherein a body member of said rail cooperating means is carried by said shiftable rail section at each of said ends thereof and a body seat of said rail cooperating means are carried by each of the respective ends of the separated rails with which said shiftable rail section coact.

8. The rail conveyor of claim 7, wherein each of said body members of said rail cooperating means is in the form of a finger-like object one end of which is secured to said shiftable rail section so that at least a predetermined portion of said finger extends outwardly therefrom towards the rail with which said shiftable rail section coact and said body seat is of a size, and configuration to receive said predetermined finger portion and is carried by the rail with which said shiftable rail section coact.

9. The rail conveyor of claim 8, wherein said finger-like object includes a flat surface and a body having ends, sides and a top rising from said flat surface with an inward taper along said sides and ends from said flat surface towards said top and said body seat is formed with sides and at least one end with tapers of a size and configuration to cooperate with those of said finger-like object.

10. The rail conveyor of claim 9, wherein said ends of said finger-like object are in the configuration of frustums of semi-cones and said sides are elongated between said ends and terminate in said top which is relatively flat and disposed in a plane parallel to a plane in which said flat surface is disposed in.

11. The rail conveyor of claim 3, wherein a rail cooperating means is disposed proximate the respective upper and lower surfaces of said shiftable rail section at each of said ends thereof and at the upper and lower surfaces of the ends of the respective rails with which said shiftable rail section coact.

12. The rail conveyor of claim 11, wherein each of said body members of each of said rail cooperating means is in the form of a finger-like object one end of which is secured to either a respective end of said shiftable rail section or the respective end of the rail with which said shiftable rail section coact so that at least a predetermined portion of each of said fingers extends outwardly therefrom towards the other of said shiftable rail section or the rail with which said shiftable rail section coact whichever is not carrying said body member and each of said body seats is of a size and configuration to receive said predetermined finger portion and is carried by the other of said shiftable rail section or the rail with which said shiftable rail section coact whichever is not carrying said body member.

13. The rail conveyor of claim 12, wherein each of said finger-like objects include a flat surface and a body section having ends, sides and a top rising from said flat surface with an inward taper along said sides and ends from said flat surface towards said top and said body seats are each formed with sides and at least one end with tapers of a size and configuration to cooperate with those of said finger-like objects.

14. The rail conveyor of claim 13, wherein said ends of said finger-like objects are in the configuration of frustums of semi-cones and said sides are elongated between said ends and terminate in said top which is relatively flat and disposed in a plane parallel to a plane in which said flat surface is disposed in.

15. The rail conveyor of claim 3, wherein a body means of said rail cooperating means are carried by said shiftable rail section at each of said ends thereof at said upper surfaces thereof and a body seat of said rail cooperating means cooperating therewith are carried by each of the respective ends of the separated rails with which said shiftable rail section coact at the upper surfaces thereof, and other body seats of others of said rail cooperating means are carried by said shiftable rail section at each of said ends thereof at said lower surfaces thereof and body members of said rail cooperating means cooperating therewith are carried by each of the respective ends of the separated rails with which said shiftable rail section coact at the lower surfaces thereof.

16. The rail conveyor of claim 15, wherein each of said body members of each of said rail cooperating means is in the form of a finger-like object one end of which is secured to its respective shiftable rail section or separated rail so that at least a predetermined portion of said finger extends outwardly therefrom towards the other one of said shiftable rail section or separated rail and said body seat is of a size, and configuration to receive said predetermined finger portion and is formed in the upper end surface of the respective one of said shiftable rail section or separated rail whichever does not carry a body member.

17. The rail conveyor of claim 16, wherein each of said finger-like objects includes a flat surface and a body having ends, sides and a top rising from said flat surface with an inward taper along said sides and ends from said flat surface towards said top and each of said body seats is formed with sides and at least one end with tapers of a size and configuration to cooperate with those of said finger-like objects.

18. The rail conveyor of claim 17 wherein said ends of said finger-like objects are in the configuration of frustums of semi-cones and said sides are elongated between said ends and terminate in said top which is relatively flat and disposed in a plane parallel to a plane in which said flat surface is disposed in.

19. The rail conveyor of claim 1, wherein said operating means includes cam means, operative during said shifting of said rail switch means, to shift said rail cooperating means in a first predetermined manner so that said body member thereof and said body seat thereof are not disposed for coaction with each other, to shift said rail switch means in a second predetermined manner between said first position and said second position, and to shift said rail switch means in a third predetermined manner so that said body member thereof and said body seat thereof shift back into said disposition of coaction one with the other.

20. A rail connector for connecting spaced rails otherwise forming a continuous path into a continuous rail path; comprising:

(a) rail section means;

(b) said rail section means being movable into a position occupying the space between the spaced rails and coacting with the spaced rails to form therewith a continuous path;

(c) rail cooperating means disposed for coaction with said rail section means and the spaced rails which the rail section means is to coact with;

(d) said rail cooperating means including at least one body member of predetermined external configuration carried either by said rail section means or a rail of the spaced rails with which said rail section means will coact, and, a body seat of a configuration corresponding to at least a portion of said external configuration of said body member and carried by either said rail section means or a rail of the spaced rails with which said rail section means will coact, whichever of same is not carrying said body member;

(e) said predetermined configuration of said body member and said predetermined configuration of said body seat being such that when said body member and said body seat are disposed for coaction with each other that load forces applied to said rail section means will facilitate alignment of said rail section means with the spaced rails to render the rail path continuous and will transfer loads applied to said rail section means directly to the spaced rails of the rail path which the rail section means is to coact with and any support structure therefor.

21. The rail connector of claim 20, wherein:

(a) said rail section means is of a predetermined length and linear configuration having upper and lower surfaces and terminating at first and second ends which are to be disposed respectively in close proximity to ends of the rails with which the rail section means is to coact and those rails also have upper and lower surfaces; and (b) at least one rail cooperating means is disposed between one of said ends of each of said rail section means and the end of the spaced rail with which said rail section means is to coact.

22. The rail connector of claim 21, wherein a rail cooperating means is disposed at least between each of said ends of said rail section means and each cooperating end of the spaced rails.

23. The rail connector of claim 22, wherein said body member of said rail cooperating means is in the form of a finger-like object one end of which is secured to either said rail section means or the rail with which said rail section means coact so that at least a predetermined portion of said finger extends outwardly therefrom towards either said rail section means of the rail with which said rail section means coact whichever said body member is not secured to and said body seat is of a size and configuration to receive said predetermined finger portion and is carried by the other of said rail section means or the rail with which said rail section means coact whichever said body member is not secured to.

24. The rail connector of claim 23 wherein said finger-like object includes a flat surface and a body section having ends, sides and a top rising from said flat surface with an inward taper along said sides and ends from said flat surface towards said top and said body seat is formed with sides and at least one end with tapers of a size and configuration to cooperate with those of said finger-like object.

25. The rail connector of claim 24, wherein said ends of said finger-like object are in the configuration of frustums of semi-cones and said sides are elongated between said ends and terminate in said top which is relatively flat and disposed in a plane parallel to a plane in which said flat surface is disposed in.

26. The rail connector of claim 25, wherein body members of said rail cooperating means are carried by said rail section means at each of said ends thereof and body seats of said rail cooperating means are carried by each of the respective rails with which said rail section means coact at the ends thereof.

27. The rail connector of claim 26, wherein rail cooperating means are disposed proximate the respective upper and lower surfaces of said rail section means at each of said ends thereof and at the upper and lower surfaces of the ends of the rails with which said rail section means coact.

28. The rail connector of claim 27, wherein said rail cooperating means disposed proximate the respective upper surfaces of said rail section means and the upper surfaces of the rails with which said rail section means coact includes a body member carried by each of the respective ends of said rail section means and a body seat carried by the respective ends of the rails with which said rail section means coact and said rail cooperating means disposed proximate the respective lower surfaces of said rail section means and the lower surfaces of the rails with which said rail section means coact includes a body seat carried by each of the respective ends of the rail section means and a body member carried by the respective ends of the rails with which said rail section means coact.

29. A rail conveyor; comprising:

(a) a rail arrangement including at least a first rail conveyor pathway and a second rail conveyor pathway which meet at at least one predetermined location and merge into a common rail pathway;

(b) said first rail conveyor pathway and said second rail conveyor pathway at said predetermined location and said common rail pathway being each discontinuous by having the respective rails thereof separated from each other end to end;

(c) rail switch support means mounting rail switch means at said predetermined location;

(d) said rail switch support means mounting said rail switch means for movement between a first position and a second position;

(e) said rail switch means carrying a first shiftable rail section and a second shiftable rail section which shift laterally when said rail switch means moves between said first position and said second position such that in said first position thereof said first shiftable rail section is disposed between and coacts with said separated rails of said first rail conveyor pathway and said common rail pathway and renders same continuous and in said second position thereof said second shiftable rail section is disposed between and coacts with said separated rails of said second rail conveyor pathway and said common rail pathway and renders same continuous;

(f) operating means carried by said rail switch support means for shifting said rail switch means between said first position and said second position; and (g) at least one rail cooperating means disposed for coaction with said rail switch means and separated rails of the rail pathways which the rail switch means is to coact with;

(h) each of said rail cooperating means to include, a body member of predetermined external configuration carried either by said rail switch means or a rail of the rail pathway with which said rail switch means will coact, and, a body seat of a configuration corresponding to at least a portion of said external configuration of said body member and carried by either said rail switch means or the rail of the rail pathway with which said rail switch means will coact, whichever of same is not carrying said body member;

(i) said predetermined configuration of said body member and said predetermined configuration of said body seat being such that when said body member and said body seat are disposed for coaction with each other that load forces applied to said rail switch means will effect an alignment of said rail switch means with the separated rails of the rail pathway which said rail switch means is to coact with to render the pathway continuous, and will transfer loads applied to said rail switch means directly to the separated rails of the rail pathway which said rail switch means is to coact with and any support structure therefor;

(j) said operating means including cam means, operative during said shifting of said rail switch means, to shift said rail cooperating means in a first predetermined manner so that said body member thereof and said body seat thereof are not disposed for coaction with each other, to shift said rail switch means in a second predetermined manner between said first position and said second position, and to shift said rail switch means in a third predetermined manner so that said body member thereof and said body seat thereof shift back into said disposition of coaction one with the other.

30. A rail conveyor; comprising:

(a) a rail arrangement including at least a first rail conveyor pathway and a second rail conveyor pathway;

(b) said first rail conveyor pathway and said second rail conveyor pathway crossing at at least one predetermined location whereat each of said rail conveyor pathways is discontinuous by having the rails thereof separated from each other end to end;

(c) rail switch support means mounting rail switch means at said predetermined location;

(d) said rail switch support means mounting said rail switch means for rotational movement between a first position wherein said rail switch means coacts with and establishes said first rail pathway as a continuous rail pathway and a second position wherein said rail switch means coacts with and establishes said second rail pathway as a continuous rail pathway;

(e) operating means carried by said rail switch support means for shifting said rail switch means between said first position and said second position; and (f) at least one rail cooperating means disposed for coaction with said rail switch means and separated rails of the rail pathways which the rail switch means is to coact with;

(g) each of said rail cooperating means to include, a body member of predetermined external configuration carried either by said rail switch means or a rail of the rail pathway with which said rail switch means will coact, and, a body seat of a configuration corresponding to at least a portion of said external configuration of said body member and carried by either said rail switch means or the rail of the rail pathway with which said rail switch means will coact, whichever of same is not carrying said body member;

(h) said predetermined configuration of said body member and said predetermined configuration of said body seat being such that when said body member and said body seat are disposed for coaction with each other that load forces applied to said rail switch means will effect an alignment of said rail switch means with the separated rails of the rail pathway which said rail switch means is to coact with to render the pathway continuous, and will transfer loads applied to said rail switch means directly to the separated rails of the rail pathway which said rail switch means is to coact with and any support structure therefor;

(i) said operating means including cam means, operative during said shifting of said rail switch means, to shift said rail cooperating means in a first predetermined manner so that said body member thereof and said body seat thereof are not disposed for coaction with each other, to shift said rail switch means in a second predetermined manner between said first position and said second position, and to shift said rail switch means in a third predetermined manner so that said body member thereof and said body seat thereof shift back into said disposition of coaction one with the other.

* * * * *